US006672426B2

(12) United States Patent
Kakimoto et al.

(10) Patent No.: US 6,672,426 B2
(45) Date of Patent: Jan. 6, 2004

(54) SOUND-INSULATING FLOOR STRUCTURES, SOUND-INSULATING FLOOR MEMBERS AND METHOD FOR CONSTRUCTING SAID SOUND-INSULATING FLOOR STRUCTURES

(75) Inventors: Hirofumi Kakimoto, Fukuyama (JP); Osamu Kiso, Fukuyama (JP)

(73) Assignee: Hayakawa Rubber Company Limited, Fukuyama (JP)

( * ) Notice: Subject to any disclaimer, the term of this patent is extended or adjusted under 35 U.S.C. 154(b) by 0 days.

(21) Appl. No.: 10/118,168

(22) Filed: Apr. 9, 2002

(65) Prior Publication Data

US 2003/0188921 A1 Oct. 9, 2003

(51) Int. Cl.[7] ..... E04F 15/18
(52) U.S. Cl. ..... 181/290; 181/293; 52/220.1
(58) Field of Search ..... 181/284, 285, 181/293, 286, 294, 295, 290; 52/220.1, 220.8, 144, 145

(56) References Cited

U.S. PATENT DOCUMENTS

| | | | | | |
|---|---|---|---|---|---|
| 906,025 | A | * | 12/1908 | Howe | 181/285 |
| 1,172,710 | A | * | 2/1916 | Howe | 181/285 |
| 1,935,537 | A | * | 11/1933 | Balduf | 181/285 |
| 3,578,105 | A | * | 5/1971 | Griff | 181/295 |
| 3,652,360 | A | * | 3/1972 | Hartman et al. | 181/290 |
| 3,656,577 | A | * | 4/1972 | Larsson et al. | 181/285 |
| 3,804,196 | A | * | 4/1974 | Horn et al. | 181/285 |
| 4,040,213 | A | * | 8/1977 | Capaul | 181/291 |
| 5,125,475 | A | * | 6/1992 | Ducharme et al. | 181/284 |
| 5,202,174 | A | * | 4/1993 | Capaul | 181/290 |
| 5,584,950 | A | * | 12/1996 | Gaffigan | 181/291 |

FOREIGN PATENT DOCUMENTS

| | | | | |
|---|---|---|---|---|
| JP | 51-30309 | | 4/1976 | |
| JP | 55-33321 | | 3/1980 | |
| JP | 64-017947 | | 1/1989 | |
| JP | 01-125464 | | 5/1989 | |
| JP | 01125464 | A * | 5/1989 | E04F/15/18 |
| JP | 2-58544 | | 4/1990 | |
| JP | 60153 | U * | 5/1990 | E04F/15/18 |
| JP | 2-60153 | | 5/1990 | |
| JP | 02274945 | A * | 11/1990 | E04B/1/98 |
| JP | 03096563 | A * | 4/1991 | E04F/15/04 |
| JP | 03197760 | A * | 8/1991 | E04F/15/18 |

OTHER PUBLICATIONS

Brief Statement Explaining the Amendment under Article 19(1) of PCT.

* cited by examiner

*Primary Examiner*—Robert E. Nappi
*Assistant Examiner*—Eduardo Colon-Santana
(74) *Attorney, Agent, or Firm*—Burns, Doane, Swecker & Mathis, LLP

(57) ABSTRACT

A sound-insulating floor structure, which can conspicuously reduce heavy floor impact sounds, is provided. The sound-insulating floor structure includes a floor base and an underfloor member. A plurality of sound-insulating floor members are arranged between the floor base and the underfloor member, and each of the sound-insulating floor members includes a plurality of impact-absorbing members and a support member supporting the impact-absorbing members. The impact-absorbing members are provided at at least one of upper and lower faces of the support member. Each of the sound-insulating floor members is fixed to the floor base or to the underfloor member, thereby supporting the underfloor member.

23 Claims, 20 Drawing Sheets

SOUND-INSULATING FLOOR STRUCTURES, SOUND-INSULATING FLOOR MEMBERS AND METHOD FOR CONSTRUCTING SAID SOUND-INSULATING FLOOR STRUCTURES

BACKGROUND OF THE INVENTION

1. Technical Field

The present invention relates to sound-insulating floor structures, sound-insulating floor members and a method for constructing said sound-insulating floor structures. Particularly, the invention relates to sound-insulating floor structures for reducing heavy floor impact sounds.

2. Background Art

Many floors have been formerly used as architectural floors, including direct bond type floors in which a sound-insulating floor is directly bonded to a floor base, floors in which a finish floor material is provided on a reinforcement member as a base member, floors in which a underfloor member is provided on floor beams and then a finish floor material is provided thereon, double floors in which a floor base member is provided on support legs and then a finish floor material is placed thereon, etc. These floors reach almost satisfactory levels for impact sounds in the case of light-weight floors. However, although improvements have been largely demanded for heavy floor impact sounds of the architectures, there have been no good improving method of reducing such sounds for a long time. Such impact sounds have been coped with by imparting rigidity upon floors or beams and increasing the thickness of floor bases in the case of the architectures having rigid structures such as RC structures only.

However, in the case of soft structures such as residential housings and low-rise collective housings, the above countermeasure results in substantially too high costs, so that it is impossible to increase rigidity of columns and beams and enhance the rigidity and the weight of the floor base. Therefore, a countermeasure has been awaited.

DISCLOSURE OF THE INVENTION

The present invention is aimed at obtaining a floor sound-insulating floor structure, which can largely reduce heavy floor sounds. Further, the invention is also aimed at sound-insulating floor members which can remarkably reduce heavy floor impact sounds and have excellent workability.

The present invention relates to a sound-insulating floor structure comprising a floor base, a plurality of sound-insulating floor members arranged on the floor base, and an underfloor member placed on the sound-insulating floor members, each of said sound-insulating floor members comprising a plurality of impact-absorbing members and a support member supporting said impact-absorbing members, said impact-absorbing members being provided on at least one of upper and lower faces of the support member, and each of said sound-insulating floor members being fixed to the floor base or the underfloor member to support the underfloor member. The invention also relates to the sound-insulating floor members to be used in the sound-insulating floor structure, and a method for constructing the sound-insulating floor structure.

The present inventors solved the problems by a simple construction in which the sound-insulating floor members are arranged on the floor base, and the underfloor member is placed thereon.

Further, the present inventors noted the cost reduction, which enables wide propagation from the standpoint of the construction members and the number of construction steps.

The inventors noted that the sound-insulating floor structure can be adjusted to such a height level that makes the underfloor height as low as possible and on the other hand provides a piping space.

Having noted the above points, the present inventors conducted experiments on the sound-insulating floor structure in detail.

As a result, the inventors obtained the knowledge that a sound-insulating floor members in which a plurality of impact-absorbing members are arranged on at least one face of a support member is placed on a floor base, and an underfloor member is placed on the sound-insulating floor members, thereby reducing heavy floor impact sounds. Then, the inventors further repeated experiments, and discovered that the heavy floor impact sounds are surprisingly further reduced when the impact-absorbing members are supported by slender support members each having a length equivalent to a long or short side of the floor base or the underfloor member, and the supporting member is fixed to the underfloor member with the impact-absorbing members having a weight being about ½ times as much as that of the sound-insulating floor members. The present inventors reached the present invention based on the above discovery.

That is, the present invention relates to a sound-insulating floor structure comprising a floor base, a plurality of sound-insulating floor members arranged on the floor base, and an underfloor member placed on the sound-insulating floor members, each of said sound-insulating floor members comprising a plurality of impact-absorbing members and a support member supporting said impact-absorbing members, said impact-absorbing members being provided on at least one of upper and lower faces of the support member, and said sound-insulating floor member being fixed to the floor base or the underfloor member to support the underfloor member. The invention also relates to the sound-insulating floor members to be used in the sound-insulating floor structure, and a method for constructing the sound-insulating floor structure.

1. The provision of the supporting member on at least one face of the plural impact-absorbing members constitutes the sound-insulating floor member, which is provided between the floor base and the underfloor member. Thereby, the sound performance can be conspicuously enhanced.
2. When the impact-absorbing members are supported by slender support members each having a length equivalent to a long or short side of the floor base or the underfloor member, the sound performance can be remarkably improved.
3. When portions where the supporting member or the impact-absorbing members contact the underfloor member or portions where the supporting member or the impact-absorbing members contact the floor base are to be subjected to fixing with pressure-sensitive adhesive, the pressure-sensitive adhesive or the like is coated on those portions, and this adhesive-coated portions are protected by applying release papers thereto. In this case, a plurality of the impact-absorbing members can be simultaneously fixed merely by press fitting them after the release papers are removed.

Further, according to the present invention,

4. If the heavy floor impact sound can be kept to $L_H$-55, a vibration control/sound-insulating floor member and other planar underfloor member can be omitted, which can reduce the cost of materials and the number of working steps.

5. The height of the underfloor can be adjusted by imparting vibration controllability upon the support member and/or increasing the thickness thereof, which is effective for improving the sound performance and lessens the displacement relative to the floor load.

According to the present invention, the provision of the sound-insulating floor members including the supporting members which supports the plural impact-absorbing members between the floor base or the underfloor member not only remarkably reduces the heavy floor impact sounds of the sound-insulating floor structure but also improves construction workability of the sound-insulating floor structure.

The present invention can be widely applied to residential houses, low-rise collective housings, high-rise collective housings, etc. The present invention can not only favorably employed in the residential housings, but also in case that upstairs heavy floor impact sounds are not to be transmitted or that the underfloor space is to be used as a space for piping, wiring or the like.

BEST MODES TO CARRYING OUT THE INVENTION

Embodiments of the present invention will be explained.

In the following, constructing members of the present invention will be explained, and functions of the invention will be successively explained, too.

(1) Sound-insulating Floor Member

The sound-insulating floor member in the present invention comprises a plurality of the impact-absorbing members and the support member supporting these impact-absorbing members. Each impact-absorbing member is provided on at least one of the upper and lower faces of the support member. A plurality of such sound-insulating floor members are used, and each fixed to the floor base or the underfloor member, thereby supporting the underfloor member.

When the sound-insulating floor members are to be fixed to the floor base or the underfloor member, use of the pressure-sensitive adhesive can conspicuously improve constructing workability.

Such a pressure-sensitive adhesive is coated or applied onto the support members or the impact-absorbing members for fixedly bonding intended to be bonded and fixed onto the floor base or the underfloor member.

The pressure-sensitive adhesive may be made of a rubber similar to that of the impact-absorbing member. In particular, if the floor base has a porous surface as in ALC or certain non-landed portions as in RC, it is necessary to adjust the thickness or the plastic deformation degree of the adhesive.

In such an adjustment, any measure needs to be considered to ensure the thickness for a long time period by utilizing a vulcanized gel component of reclaimed rubber, by utilizing a partially vulcanized rubber, or by laminating the adhesive upon a foam or fibers or by utilizing them in a combination. The thickness is ordinarily preferably set at a range of 0.5 to 3 mm.

Since a low molecular weight oil or the like in a softener of the pressure-sensitive adhesive is likely to move into the underfloor member or the floor base. A softener or plasticizer having a relatively high molecular weight is preferably used in consideration of compatibility rubber or polymer.

(1—1) Support Member

The support member in the present invention supports a plurality of the impact-absorbing members as explained later, and serves to set the space between the floor base and the underfloor member at an arbitrary height.

When the support member is in the form of bars, the length of the bars may be almost identical with that of a long side or short side of the floor base or the underfloor member. A pressure-sensitive adhesive may be provided thereon. Such may be alternatively fixed to the floor base and the underfloor members. Thereby, the sound performance and the construction speed are improved beyond expectation.

As the material for the supporting member, use may be singly or in combination made of wood materials such as wood, plywood laminate, wood-wool cement board, laminated wood, particle board and hard board, strips, boards, folded plates and cylindrical members of metal or alloy strips such as iron, aluminum, brass and stainless steel, inorganic materials such as cements, gypsum, ALC, pipe-shaped extruded cement glass, and polymers such as rubber, plastics, fibers and papers.

As the support member, the boards or strips may be used to reduce the cost as much as possible. The support member having vibration controllability or rigidity is preferred. Thus, foamed polymers, rubber solid or plastic solid or products obtained by crushing a foam and solidifying the crushed pieces with a binder, products obtained by surrounding their opposite sides or peripheral sides with laminated boards, cardboards or plastic cardboards to increase the rigidity, folded plates of slender planar metal thin plate strips bent in width direction, and cylindrical products of such as metals, cement, plastics and papers are preferred.

When the support member comprises the folded plates or cylindrical members, bending rigidity of the support member itself increases, and a compression deformation amount of the floor can be reduced. Further, the vibration-controlling, sound-insulating floor members and other planar members constituting the underfloor member can be reduced. In addition, since the original sound performance is improved, the sound performance is enhanced.

In particular, when the support member comprises metallic folded plates each having a C-letter or H-letter or T-letter section or the like or cylindrical support members are used, rigidity becomes high for the thickness.

However, when the metallic folded members, cylindrical members or the like are used as the support members, they may be impact sound-generating sources. They can be prevented from becoming impact sound-generating source when at least one material selected from the group consisting of a foamed material, a fibrous material, powder, binder-solidified powdery material or a damping material is charged inside hollow portions between the folded plates or inside the cylindrical members.

The support members in the present invention can be prevented from becoming sound-generating sources when non-restraint type vibration controllability is imparted by bonding the pressure-sensitive adhesive to them or when restraint type controllability is imparted by attaching a thin metal or rigid polymer sheet or film on one faces of the pressure-sensitive adhesive materials.

Further, in order to accelerate vibration attenuation of the underfloor member or the support members upon receipt of impacts by imparting vibration controllability upon the support members as mentioned above, the support members having restraint type vibration controllability may be formed by combining plural sets of the support members and the viscoelastic material when the support members are in the form of strips, boards, bars or the like.

The folded metal planar member and the cylindrical member need to be prevented from becoming sound-generating sources and increase vibration control-attenuating property through being subjected to the vibration-controlling treatment as mentioned above.

As in the impact-absorbing member used in the present invention, vibration-controlling property and adhesion of the viscoelastic material which imparts restraint type vibration-controlling property to such support members may be adjusted by incorporating, if necessary, an anti-aging agent, a bituminous material, a wax, a high specific gravity filler, a coupling agent, a crosslinking agent, etc. into a main component composed of a polymer component selected from various rubber materials or rubber-like materials and thermoplastic materials singly or in a combined use and a softener, an adhesion-imparting resin, a filler, etc. appropriately added.

Such a viscoelastic material may be used as a non-restraint type vibration-controlling material bonded to a part or an entire part of the folded planar support member or the cylindrical support member. Alternatively, vibration can be controlled by bonding it to a part of or an entire part of the support member as a restraint type vibration-controlling material in the state that a metallic foil or a rigid plastic film is bonded to one side of the viscoelastic material or the bent inner space.

When the viscoelastic material is used as the non-restraint vibration-controlling material at that time, it may be effective when its thickness is equal to or more than that of the support member. The restraint type vibration-controlling member may be effective when the viscoelastic material is relatively thin. Particularly, the effect can be achieved even in a thin thickness of around dozens microns by selecting the viscoelastic material or a restraint material.

The support material is not particularly limited to any length, but construction workability and planar vibration-preventing effect can be enhanced by making the length of the support member nearly equal to that of the long side or short side of the floor base or a planar member arranged in the lowermost layer of the underfloor member.

(1–2) Impact-absorbing Material

A plurality of the impact-absorbing members in the present invention are arranged on either upper or lower face of the support member at an arbitrary interval.

As such impact-imparting members, solid such as rubber or plastic, a unitary foam or a composite foam, a binder-fixed product of crushed rubber or plastic solid or foamed product, rubber into which gas, liquid or powder of foamed body, fibers, clay, rubber-plastic, inorganic metal is sealed, or a metal spring may be recited.

The impact-absorbing member can possess at least one spring characteristics selected from those of a linear spring, a degressive spring, progressive spring and a stationary load spring.

When the viscoelastic material is used as the impact-absorbing member, vibration-controlling property can be imparted upon absorption of vibration. Particularly, when a highly elastic impact-absorbing member such as the metal spring is used, the impact-absorbing effect can be conspicuously enhanced and surging of the floor can be prevented, when used in combination.

The impact-absorbing member is required to fully withstand the compression load for a long time period and to have a high impact-absorbing effect and a good walking feeling.

As the material for the impact-absorbing member, mention may be made of rubbers and various reclaimed rubbers including natural rubber, styrene-butadiene rubber, butadiene rubber, isoprene rubber, chloroprene rubber, acrylonitrile-butadiene rubber, ethylene-propylene rubber, butyl rubber, urethane rubber, polysulfide rubber, chlorosulfonated polyethylene, chlorinated polyethylene, epichlorohydrine rubber, acryl rubber, polynorbornene rubber, silicone rubber and fluorinated rubber, by way of example.

In the present invention, a rubbery viscoelastic material may be used. As such a rubbery viscoelastic material, a rubbery-like material may be favorably used. As such a rubbery-like material, a polystyrene-based thermoplastic elastomer (hereinafter referred to as TPE) in which a hard segment is styrene and a soft segment is polybutadiene, polyisoprene or hydrogenated polybutadiene, a polyolefin TPE in which a hard segment is polyethylene or polypropylene and a soft segment is ethylene propylene copolymer rubber, a chlorinated polyvinyl chloride TPE in which both hard and soft segments are polyvinyl chloride, a polyester-based TPE in which a hard segment is polyurethane resin and a soft segment is polyether, a polyamide-based TPE in which a hard segment is a polyamide and a soft segment is polyether or polyester, TPE in which a hard segment is syndiotactic-1,2-butadiene and a soft segment is atactic-1,2-butadiene and, a rubber obtained by curing a polymer having two or more terminal reactive groups per molecule in the main skeleton as a room temperature reactive liquid rubber, for example, polybutadiene, chloroprene, isoprene, styrene butadiene, or acrylonitrile butadiene together with a compound having reactivity with the above terminal reactive groups. The present invention widely calls the above materials "rubbers" or "rubber-like materials".

The rubber-like material can improve dynamic characteristics of rubber and possess advantageous cost performance, when used in combination with rubber powder or plastic powder.

In the present invention, the impact-absorbing member may be made of at least one kind of rubbers selected from the group consisting of a gas-sealed rubber, fiber-sealed rubber, foam-sealed rubber, clay-sealed rubber and liquid-sealed rubber. The rubber in which gas, fibers, foam, powder, clay, liquid or the like is sealed has properties similar to those of the pneumatic spring or liquid-sealed spring, and reduces the characteristic frequency.

Such a gas- or liquid-sealed rubber may be formed such that a closed air chamber is formed with a film, and surrounded with a room temperature-reactive liquid rubber. Similarly, the fibers, foam, clay or viscous material may be coated and surrounded with the room temperature-reactive liquid rubber.

The impact-absorbing member in the present invention enhances its effect by making the repulsion elasticity extremely small. For this purpose, polynorbornene rubber, polyisobutylene rubber, butyl rubber, EPT or the like is preferably used singly or in combination.

A plastic elastic material may be used as the impact-absorbing member in the present invention. Such plastic elastic materials may be broadly classified into thermoplastic resins, thermosetting resins and engineering resins.

As the thermoplastic resin, mention may be made of polyethylene, polypropylene, poly-4-methylpentene, ionomer, vinyl chloride, polyvinylidene chloride, polystyrene, acrylonitrile-styrene copolymer, mixture (ABS resin) of polybutadiene to acrylonitrile-styrene copolymer, methacryl resin, polyvinyl alcohol, vinyl ethylene acetate copolymer, cellulose acetate plastic, saturated polyester resin, polyvinyl butylate resin, polyvinyl formal resin, etc., by way of example.

As the thermosetting resin, mention may be made of phenol resin, urea-melamine resin, epoxy resin, polyurethane resin, unsaturated polyester resin, silicone resin, etc., by way of example.

As the engineering resin, mention may be made of polyamide resin, polyacetal resin, polycarbonate resin, polyphenylene ether, polytetrafluoro-ethylene, polysulfone, polyether imide, polyether sulfone, polyether ketone, polyamideimide, polyimide, etc., by way of example.

As the metal spring, mention may be made of coil spring, plate spring, leaf spring, springs in which spring characteristic is utilized in the state that rubber or plastics is partially provided on upper and lower side of a spring steel, etc., by way of example.

The impact-absorbing members may have different impact-absorbing powers depending upon the shape, height, hardness, etc., even through the same material is used. The used number or the combination of the impact-absorbing members may be determined under consideration of the displacement and impact-absorbing characteristics.

For example, the heavy floor impact sounds may be further reduced by the construction that the impact-absorbing members comprises higher impact-absorbing members and lower impact-absorbing members, the higher impact-absorbing members support the underfloor member, spaces are formed between the lower impact-absorbing members and the underfloor member, the support members or the floor base, and when the underfloor member displaces upon receipt of the impact, the lower impact-absorbing members contact the underfloor member, the support members or the floor base.

Although satisfactory effects can be exhibited by only one kind of the impact-absorbing members, the impact-absorbing effect and the displacement amount are more easily balanced when two or more kinds in combination of the impact-absorbing members are used preferably such that each of the impact-absorbing members has at least one spring characteristic selected from the group consisting of linear spring characteristic, degressive spring characteristic, progressive spring characteristic and stationary load spring characteristic, and at least some impact-absorbing member (s) has (have) a different spring characteristic from that of other.

The above-mentioned impact-absorbing members may be attached to the support members, the floor material or the floor base with adhesive or pressure-sensitive adhesive. In the case of the metal spring, it may be that the spring is attached to a base seat and the base seat is fitted to the support member with screws or adhesive. Further, in case of the metal spring, a conical coil spring, which hardly abuts a bottom thereof upon receipt of impacts, is preferred from the standpoint of preventing aqueak of the metal and contact sounds between the floor base. When foam or fibers are filled in the spring, squeak between spring turns may be prevented. When a plastic cap is provided at a top portion of the spring, contact sounds between the floor material or the floor base can be prevented.

(2) Floor Base

The floor base in the present invention is a floor body itself extended over beams. The support members to which the impact-absorbing members are attached are located above the floor base and support the floor material such as the underfloor member.

As the floor base, mention may be made of RC floor bases, hollow cement floor bases, ALC floor bases, wood floor panels, etc., by way of example. The present invention may be applied to all floor bases, so long as they are floor bases of houses and buildings.

The heavy floor impact sounds, which differ depending upon the floor bases, can be improved by 2 or 3 ranks as compared with the original floor base performance by employing the sound-insulating floor structure according to the present invention.

(3) Underfloor Member

On the underfloor member in the present invention is provided a finish floor material or the like. The underfloor member influences the floor-walking feeling, floor load-displacement amount, and sound performance.

The underfloor member should have possess a weight and rigidity through laminating a laminate plate, a particle board, gypsum, a sound-insulating and vibration-controlling matt, etc.

The rigidity of the underfloor member may be increased not only by screws on laminating but also by bonding with adhesive. It is necessary to laminate planar members constituting the underfloor member on laminating such that the planar members are laminated alternatively in long-side and short-side directions. By so doing, seams between lower planar members are covered with upper planar members, so that the strength of the floor can be made almost uniformly, and no different waling feeling occurs.

In the present invention, when the slender support members are used, the vibration of the planar members can be effectively suppressed, if the impact-absorbing members are supported by the support members having almost the same length as that of the long side of the planar member at the lowermost layer of the underfloor member.

Further, according to the present invention, the height of the under-floor space can be increased by the support members, if a room is required for wiring or the like in the underfloor space.

In this case, when the rigidity of the support members is increased, the displacement of the underfloor space can be reduced, the flow of air upon impact on the floor can be decreased, and the floor structure is less susceptible to adverse effects of the floor impact sounds.

Therefore, when the impact-absorbing members are fixed in the state that the length of the support members is almost equal to that of the long or short side of the underfloor member, the rigidity of the underfloor member increases and the impact sounds are reduced with increase in rigidity of the support members. Therefore, the number of laminated underfloor members can be reduced.

The thicker the lowermost layer of the underfloor member, the less the warped amount due to the impact and the floor load, which results in reduction in the number of the laminated plates.

A finish floor material may be placed on the underfloor member. As the finish floor material, any material as ordinarily used may be employed.

The sound-insulating floor structure according to the present invention has highly improving effect upon not only the heavy floor impact sounds but also the light floor impact sounds, so that a sound-insulating floor for reducing the light floor impact sounds needs not be used because it results in increased cost only.

The sound-insulating floor structure according to the present invention will be explained, mainly directed to the construction workability.

The present invention can be applied to the RC floor base which is continued as well as the ALC and the wood floor panel in which floor bases are separated one by one.

In the present invention, when the sound-insulating floor members in which plural impact-absorbing members are provided at at least one face of the support members are used, the sound-insulating members may be independently arranged at an arbitrary interval on the floor and the underfloor member is placed on the sound-insulating floor members such that seams may not be overlapped with one another. In case that the support members are slender and the floor base or the underfloor member is formed by combining a plurality of slender floor bases or a plurality of slender underfloor members in the same direction, the sound-insulating floor members may be arranged such that they may be orthogonal to the seams of the floor bases or the underfloor members.

According to this construction method, when the long side direction of the impact-absorbing member-provided support members is in conformity with that of the floor bases and 2 or 3 impact-absorbing member-provided support members are arranged for one floor base, constructing workability is high in that arrangement may be made visually for each floor base.

The underfloor member may be effectively formed above the floor base irrespective of the continuity of the floor bases from the standpoint of the constructing efficiency when the pressure-sensitive adhesive is provided on contact faces of the support members or the impact-absorbing members, long sides of two to three impact-absorbing member-attached support members are bonded to those of the underfloor member after protection release papers for the pressure-sensitive adhesive are removed, and the underfloor members are turned over.

So long as this method is used, the long sides of the support members and the underfloor member may be arranged orthogonal the long side direction of the floor base, which is an arrangement more advantageous for the displacement of the floor load. Further, as mentioned above, the method for fixing the floor base or the underfloor member with the pressure-sensitive adhesive is easier than a method for fixing the members to the floor base with the screws.

Furthermore, if the support members with the impact-absorbing members are slender in a length equal to or slightly shorter than that of the long side of the floor base or the underfloor member, two or three support members are used for one floor base or underfloor member. Therefore, arrangement can be easily visually effected, so that vertical and longitudinal marking may be omitted. Further, two or three support members are arranged, which enables very rapid construction.

Moreover, since the method using the slender support members in the present invention affords a simple arrangement, it has a merit with no constructing mistake.

BEST MODES FOR CARRYING OUT THE INVENTION

The present invention will be explained in more detail with reference to the drawings.

Figure 1:
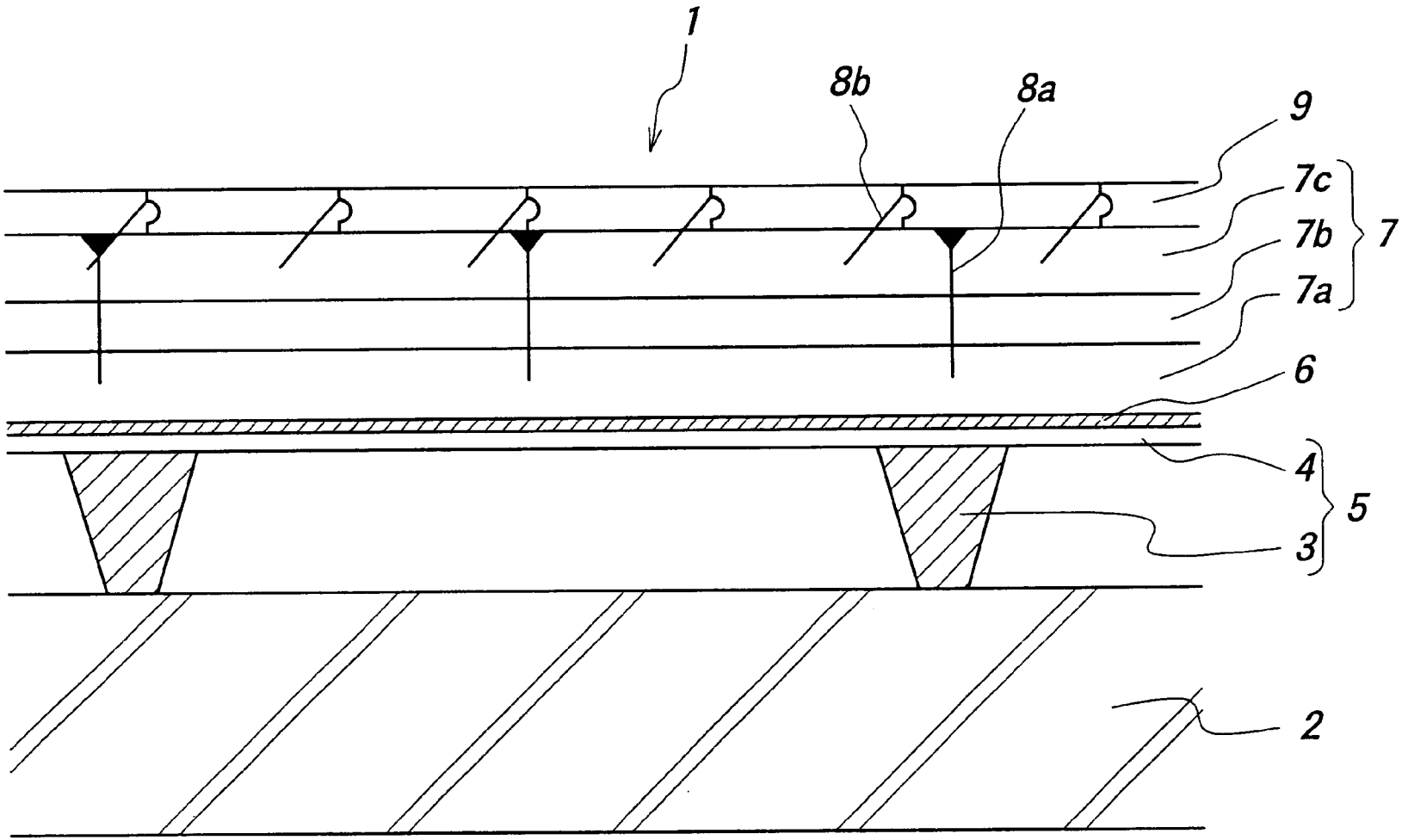
FIG. 1 is a partially sectional view of an embodiment of the sound-insulating floor structure according to the present invention when cut as viewed in a longitudinal direction of the sound-insulating floor members.
Figure 2:
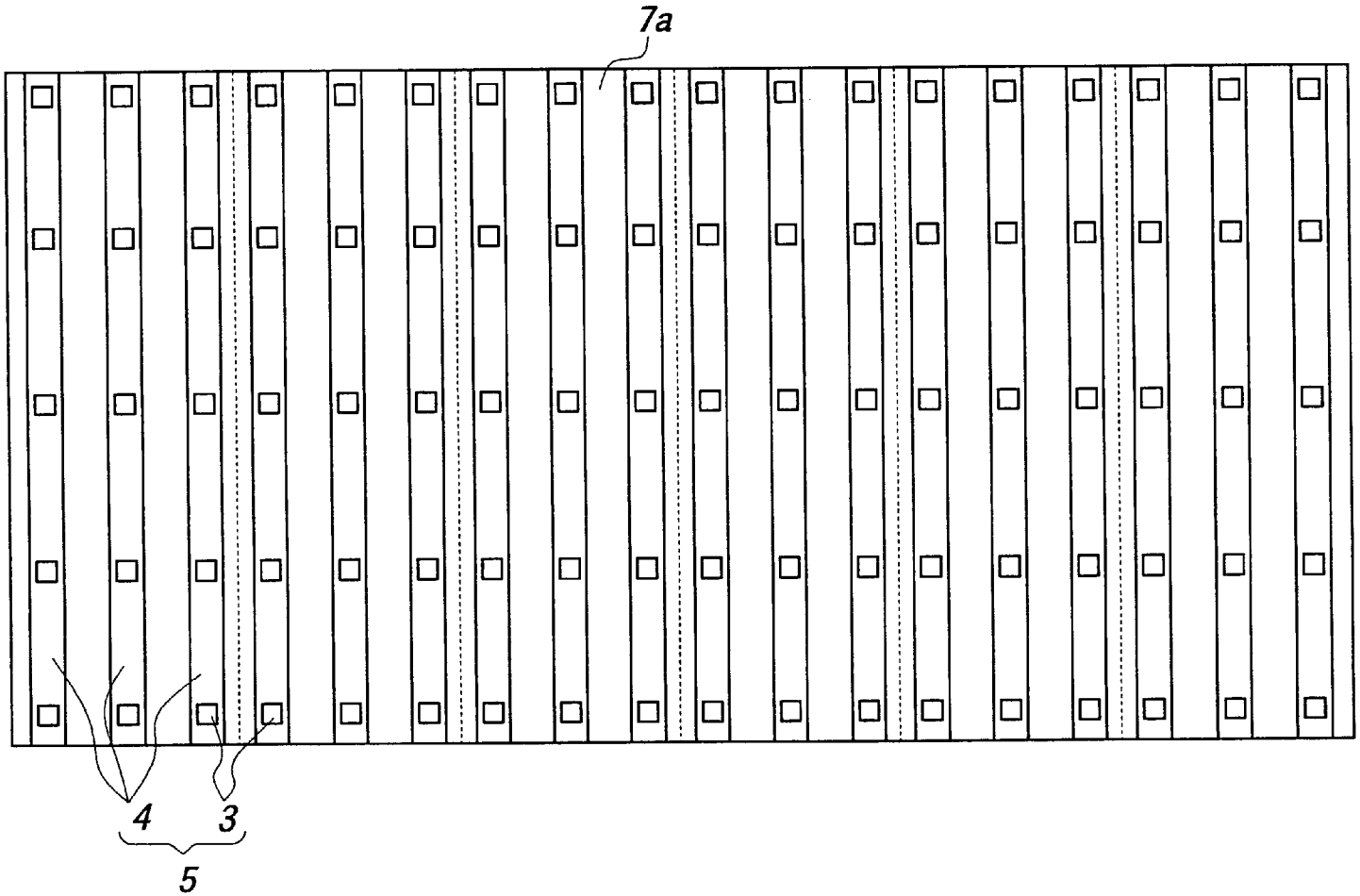
FIG. 2 is a back face view of the sound-insulating floor members used in the sound-insulating floor structure of FIG. 1 as viewed from the lower side.
Figure 3:
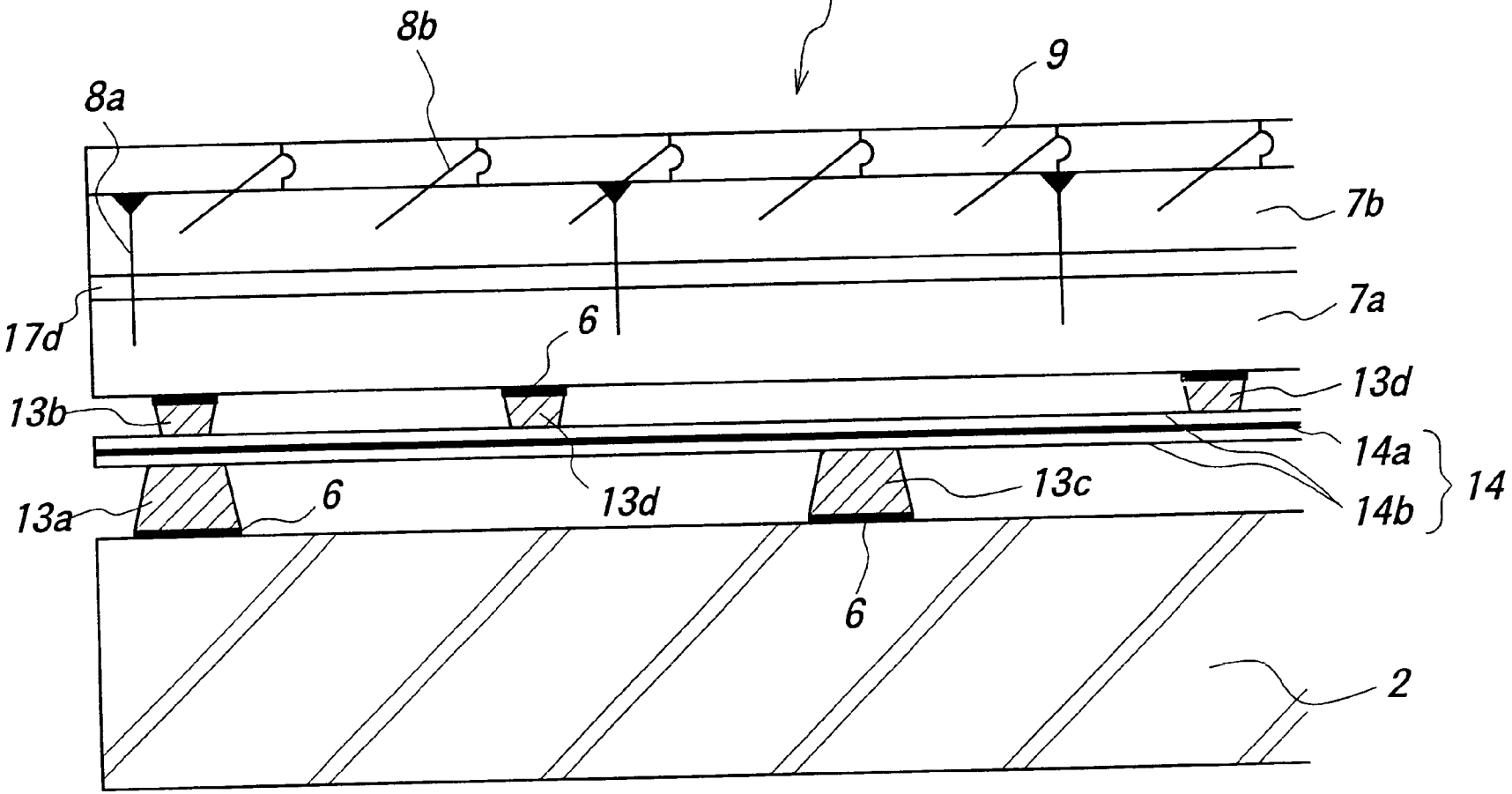
FIG. 3 is a partially sectional view of another embodiment of the sound-insulating floor structure according to the present invention.
Figure 4:
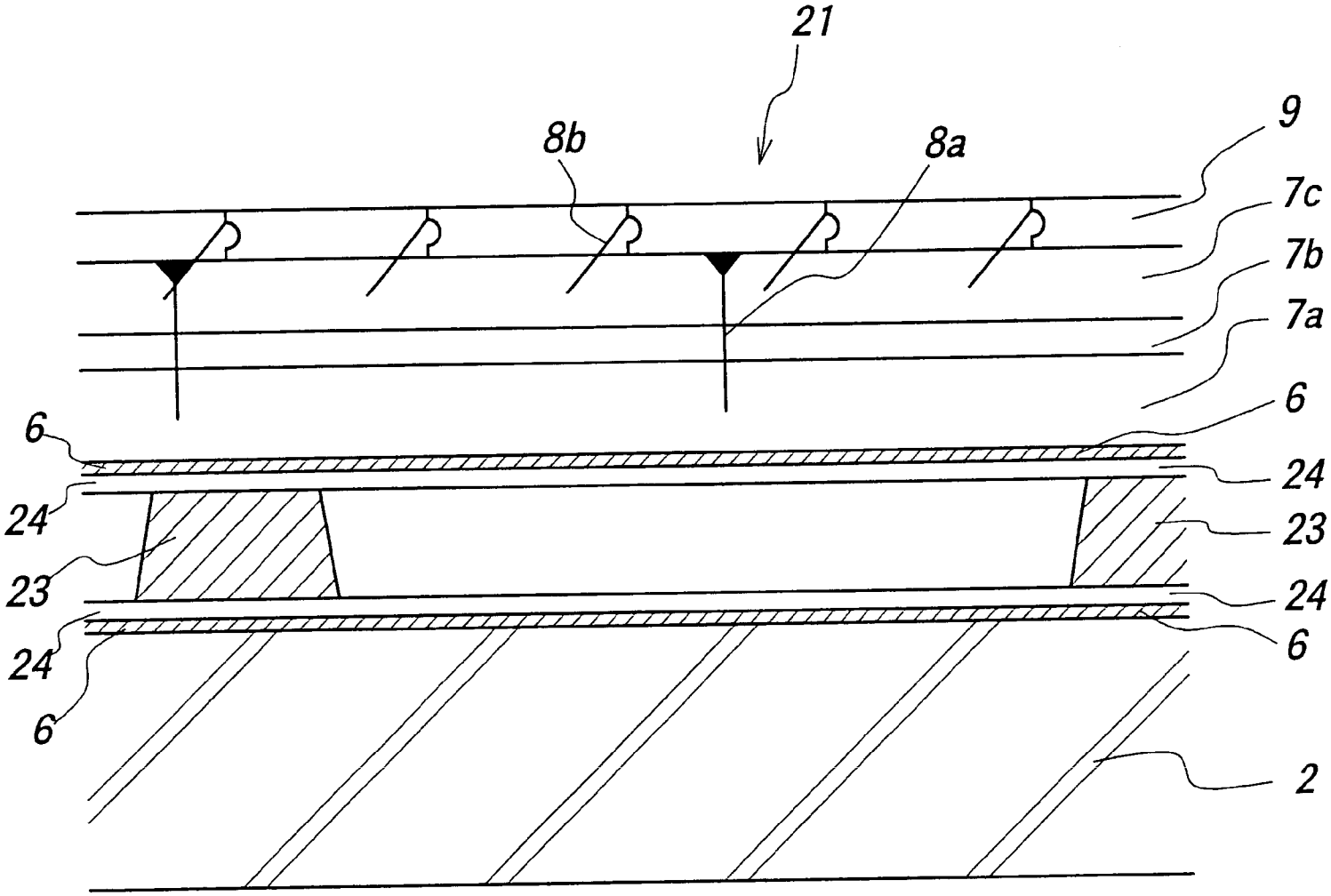
FIG. 4 is a partially sectional view of a further embodiment of the sound-insulating floor structure according to the present invention.
Figure 5:
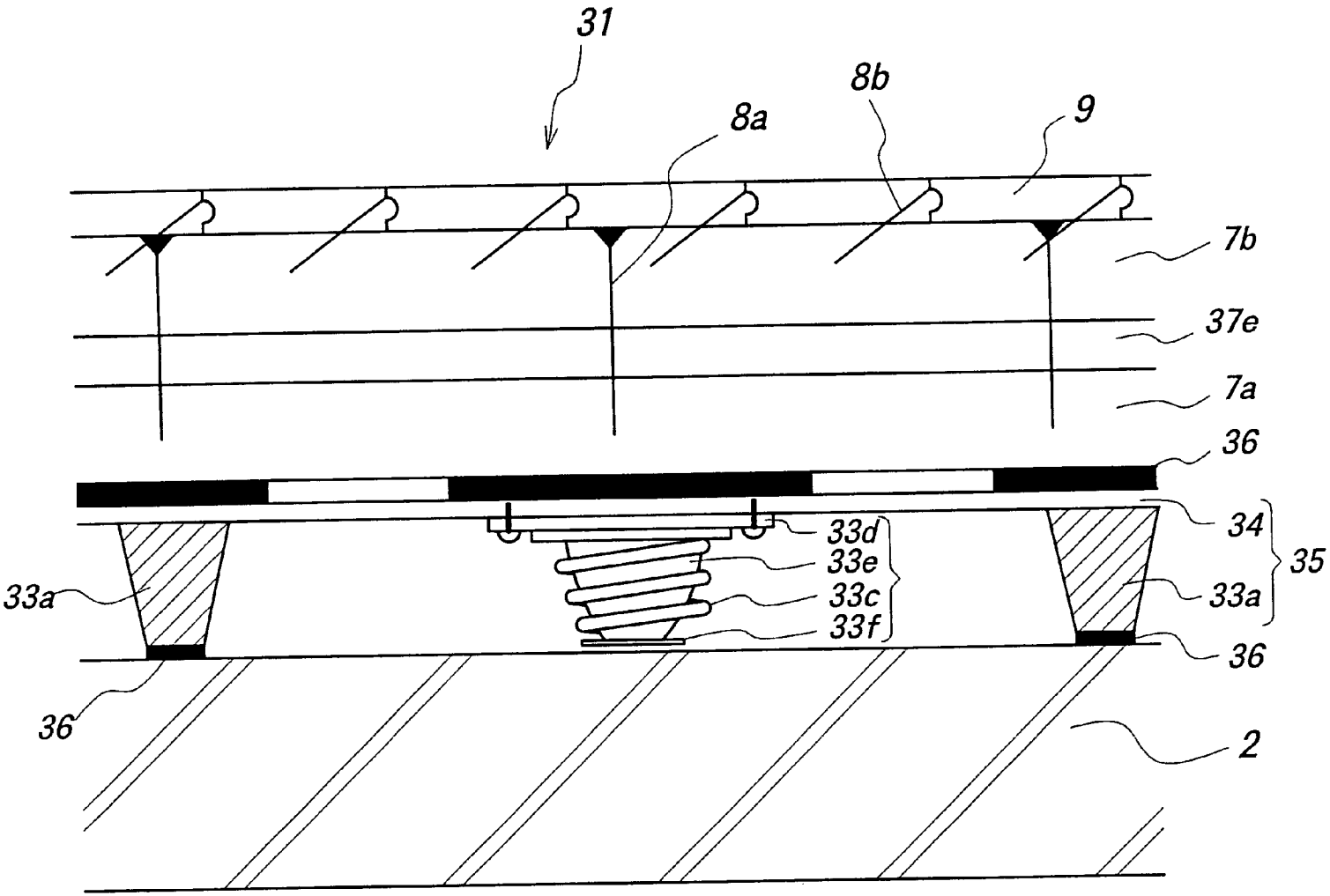
FIG. 5 is a partially sectional view of a still further embodiment of the sound-insulating floor structure according to the present invention.
Figure 6:
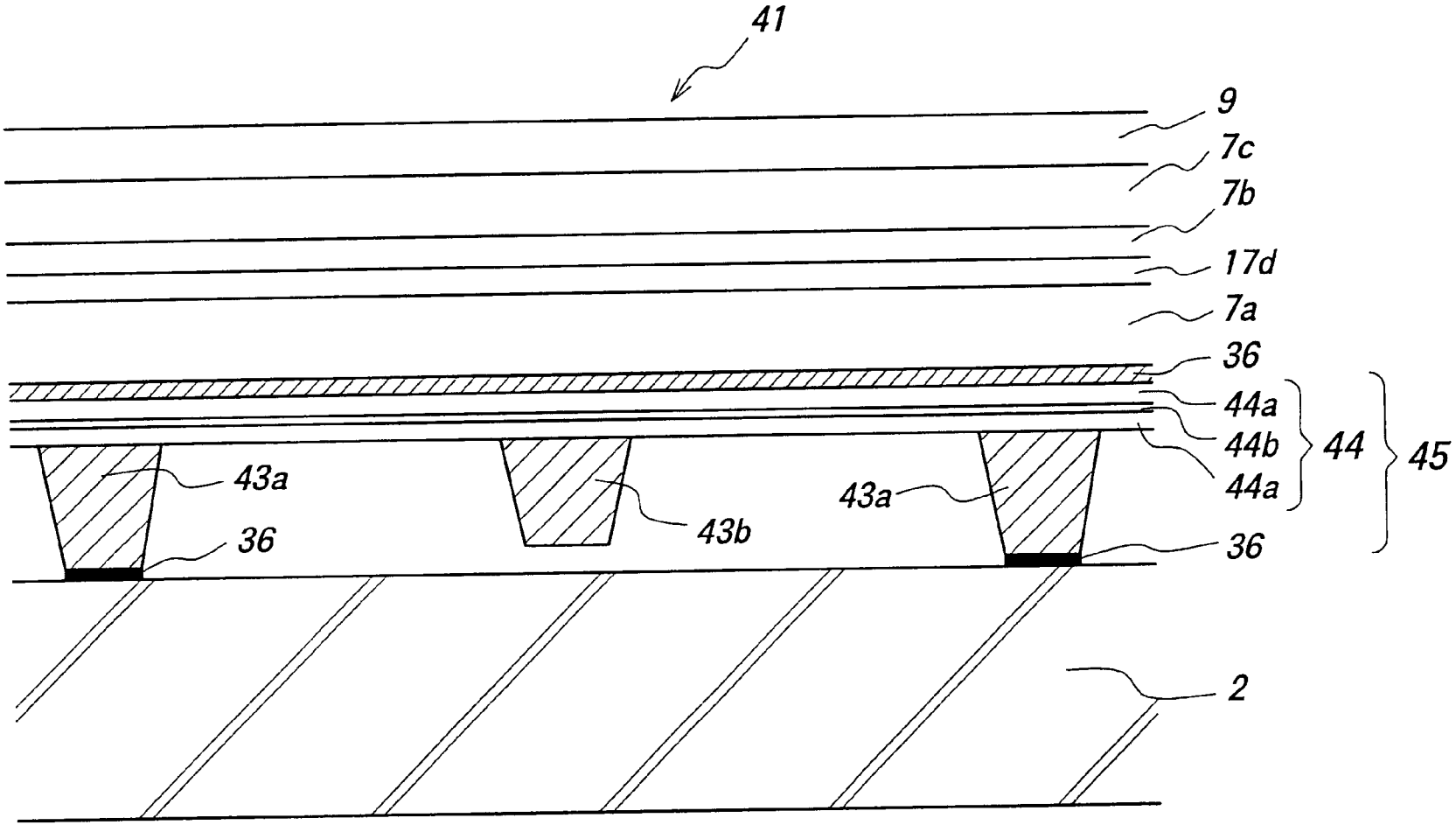
FIG. 6 is a partially sectional view of a still further embodiment of the sound-insulating floor structure according to the present invention.

FIG. 1 is a partially sectional view of an embodiment of the sound-insulating floor structure according to the present invention when cut as viewed in a longitudinal direction of the sound-insulating floor member. FIG. 2 is a back face view of the sound-insulating floor members used in the sound-insulating floor structure of FIG. 1 as viewed from the lower side. FIG. 3 is a partially sectional view of another embodiment of the sound-insulating floor structure according to the present invention. FIG. 4 is a partially sectional view of a further embodiment of the sound-insulating floor structure according to the present invention. FIG. 5 is a partially sectional view of a still further embodiment of the sound-insulating floor structure according to the present invention. FIG. 6 is a partially sectional view of a still further embodiment of the sound-insulating floor structure according to the present invention.

Figure 7:
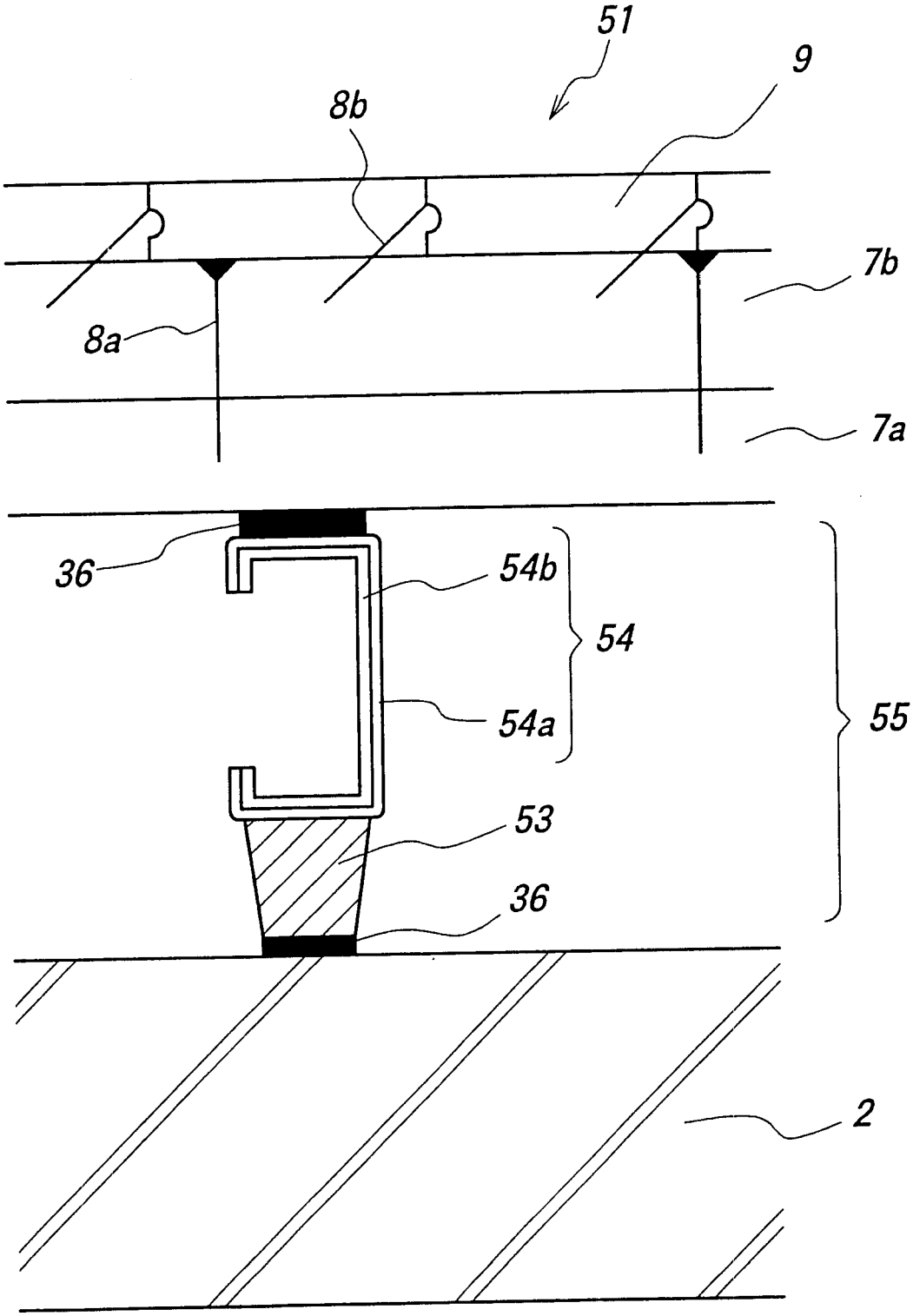
FIG. 7 is a partially sectional view of a still further embodiment of the sound-insulating floor structure according to the present invention.
Figure 8:
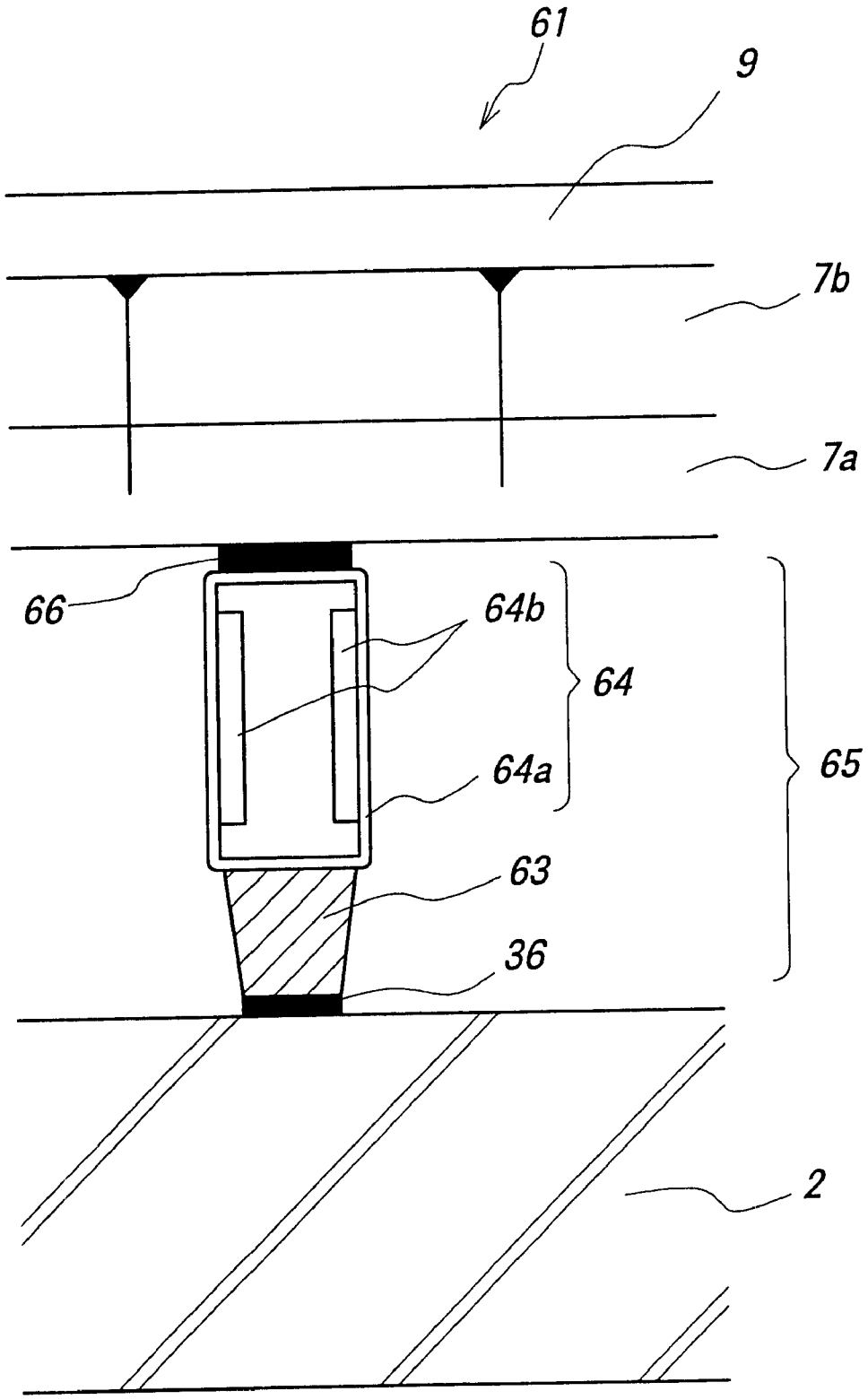
FIG. 8 is a partially sectional view of a still further embodiment of the sound-insulating floor structure according to the present invention.
Figure 9:
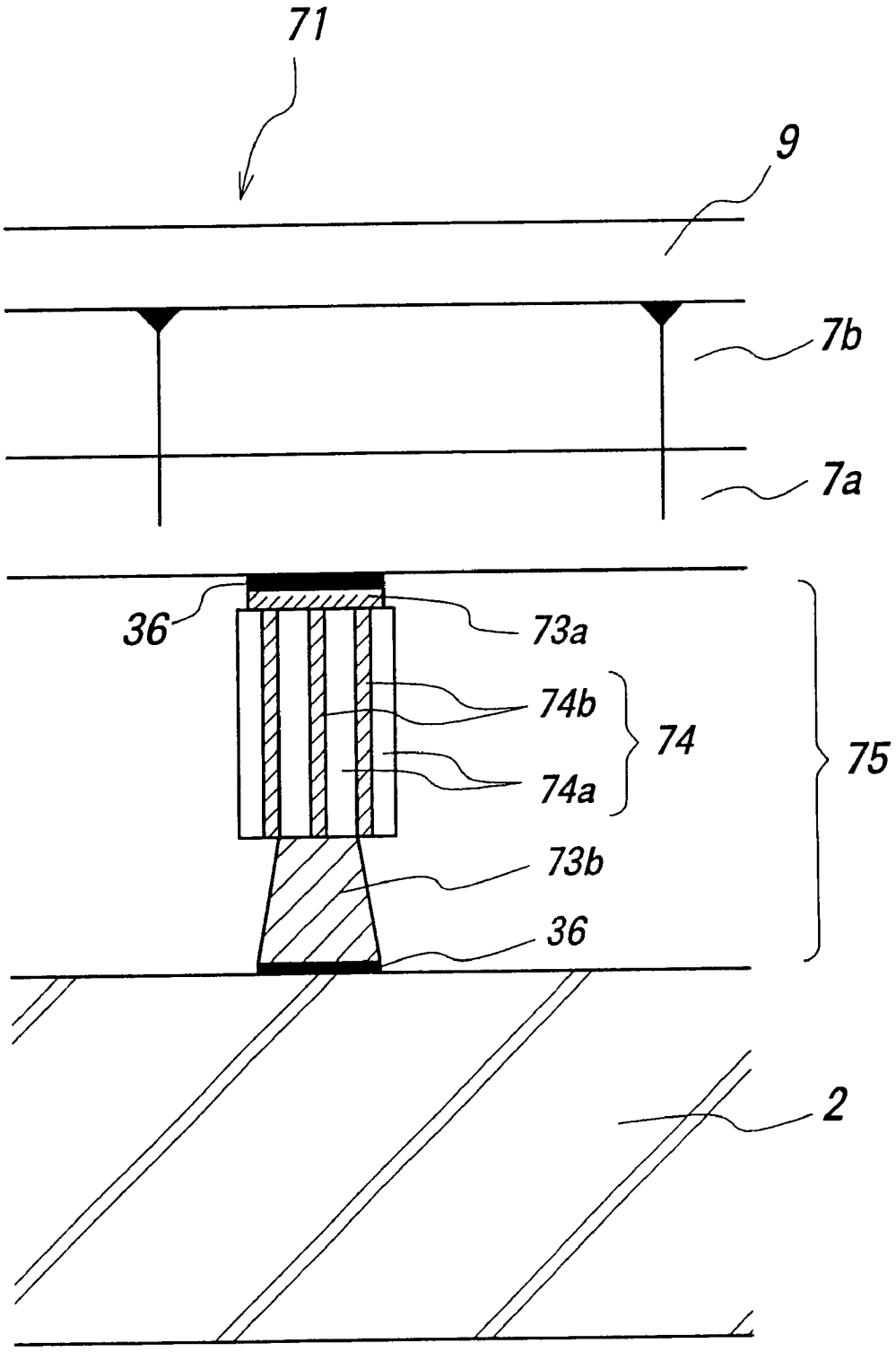
FIG. 9 is a partially sectional view of a still further embodiment of the sound-insulating floor structure according to the present invention.
Figure 10:
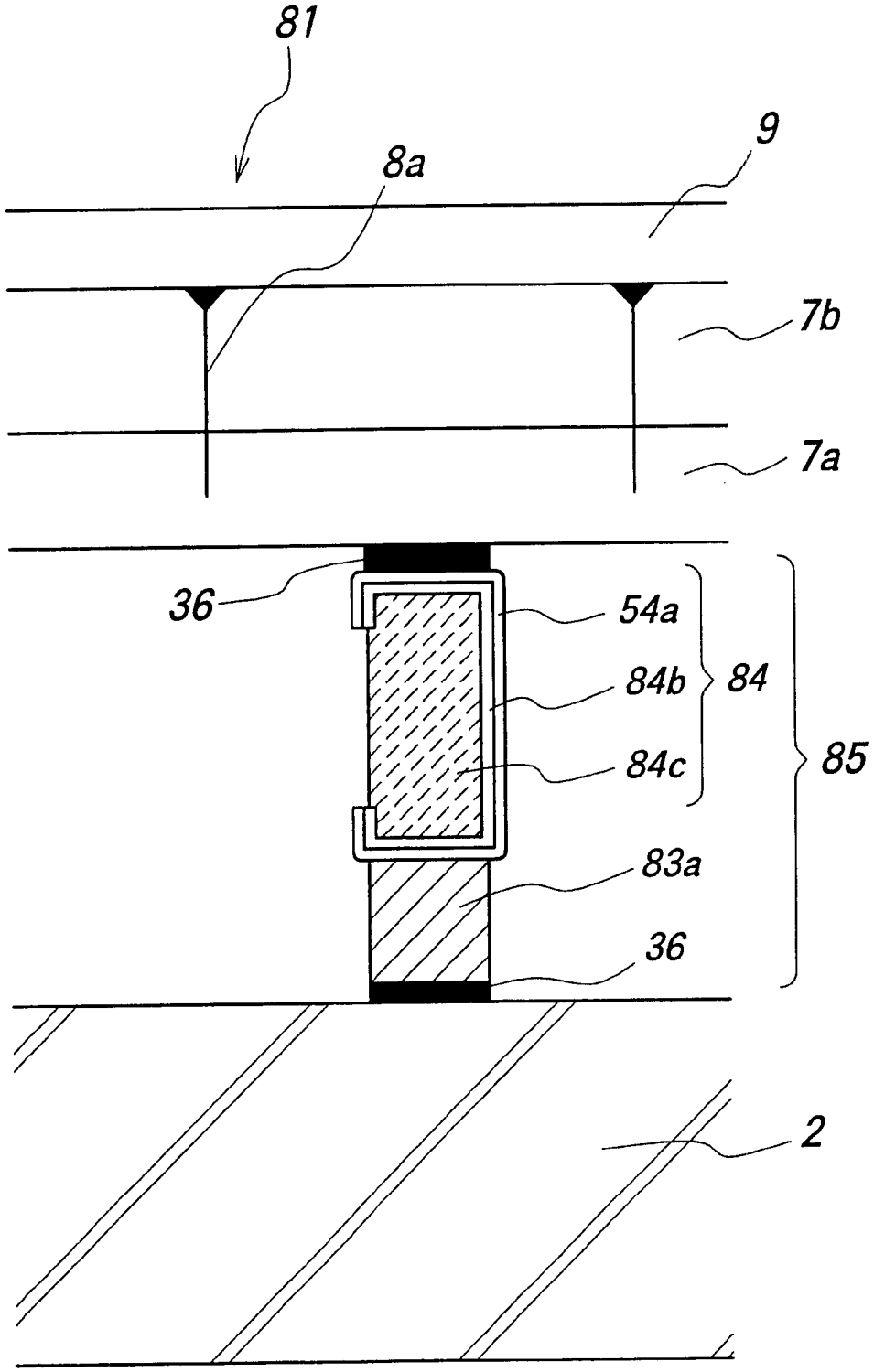
FIG. 10 is a partially sectional view of a still further embodiment of the sound-insulating floor structure according to the present invention.
Figure 11:
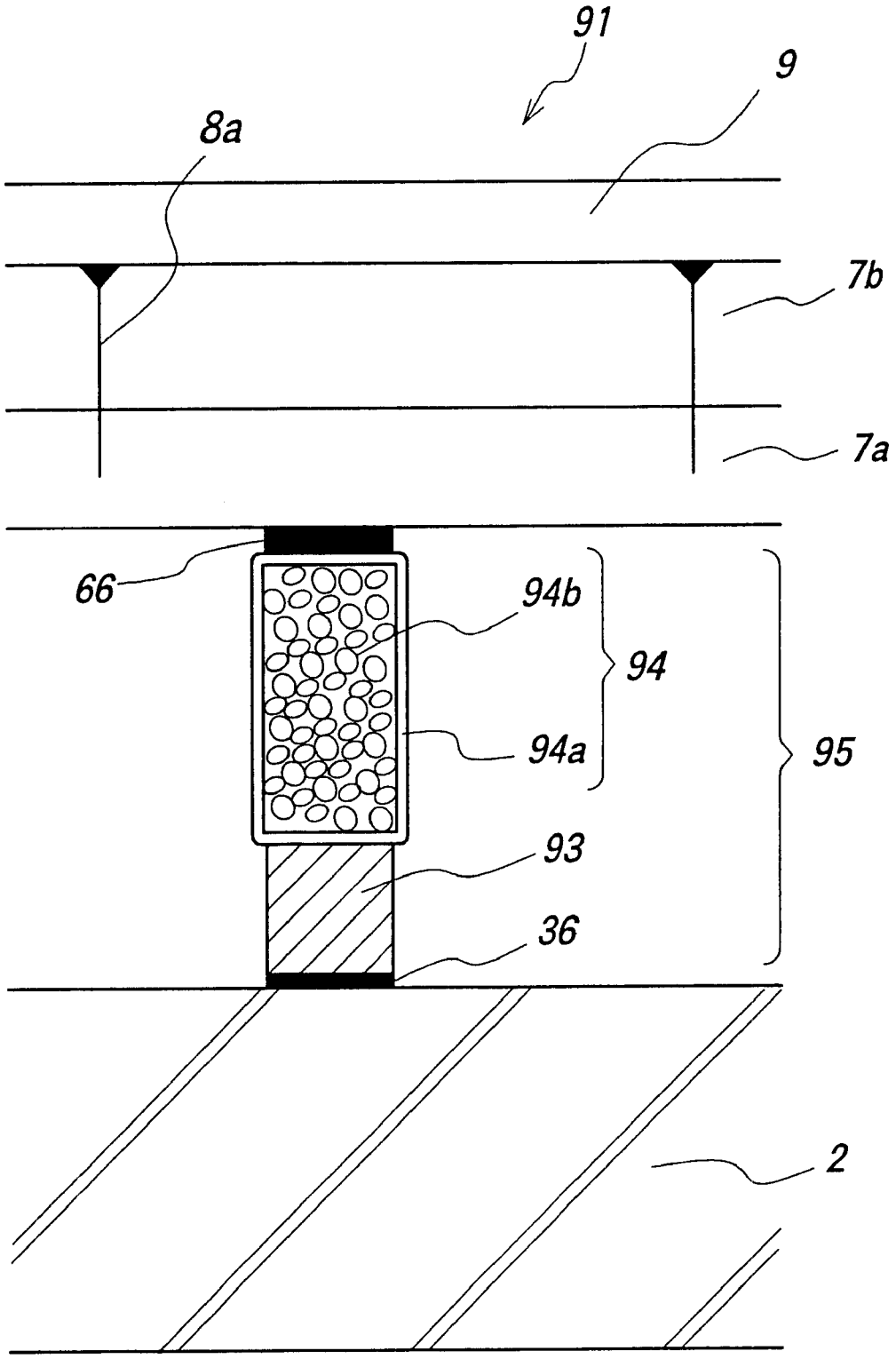
FIG. 11 is a partially sectional view of a still further embodiment of the sound-insulating floor structure according to the present invention.

FIG. 7 is a partially sectional view of a still further embodiment of the sound-insulating floor structure according to the present invention. FIG. 8 is a partially sectional view of a still further embodiment of the sound-insulating floor structure according to the present invention. FIG. 9 is a partially sectional view of a still further embodiment of the sound-insulating floor structure according to the present invention. FIG. 10 is a partially sectional view of a still further embodiment of the sound-insulating floor structure according to the present invention. FIG. 11 is a partially sectional view of a still further embodiment of the sound-insulating floor structure according to the present invention.

Figure 12:
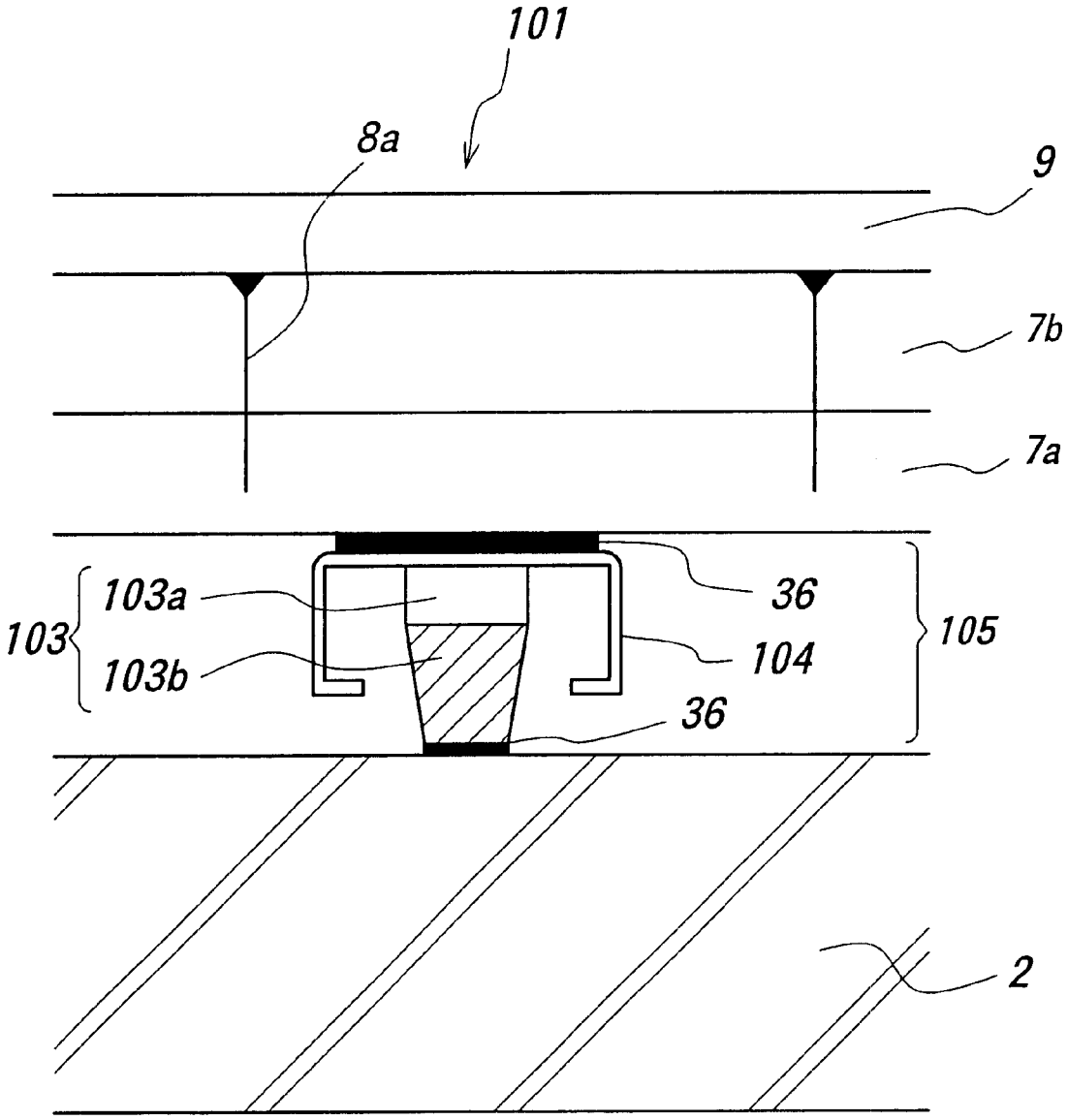
FIG. 12 is a partially sectional view of a still further embodiment of the sound-insulating floor structure according to the present invention.
Figure 13:
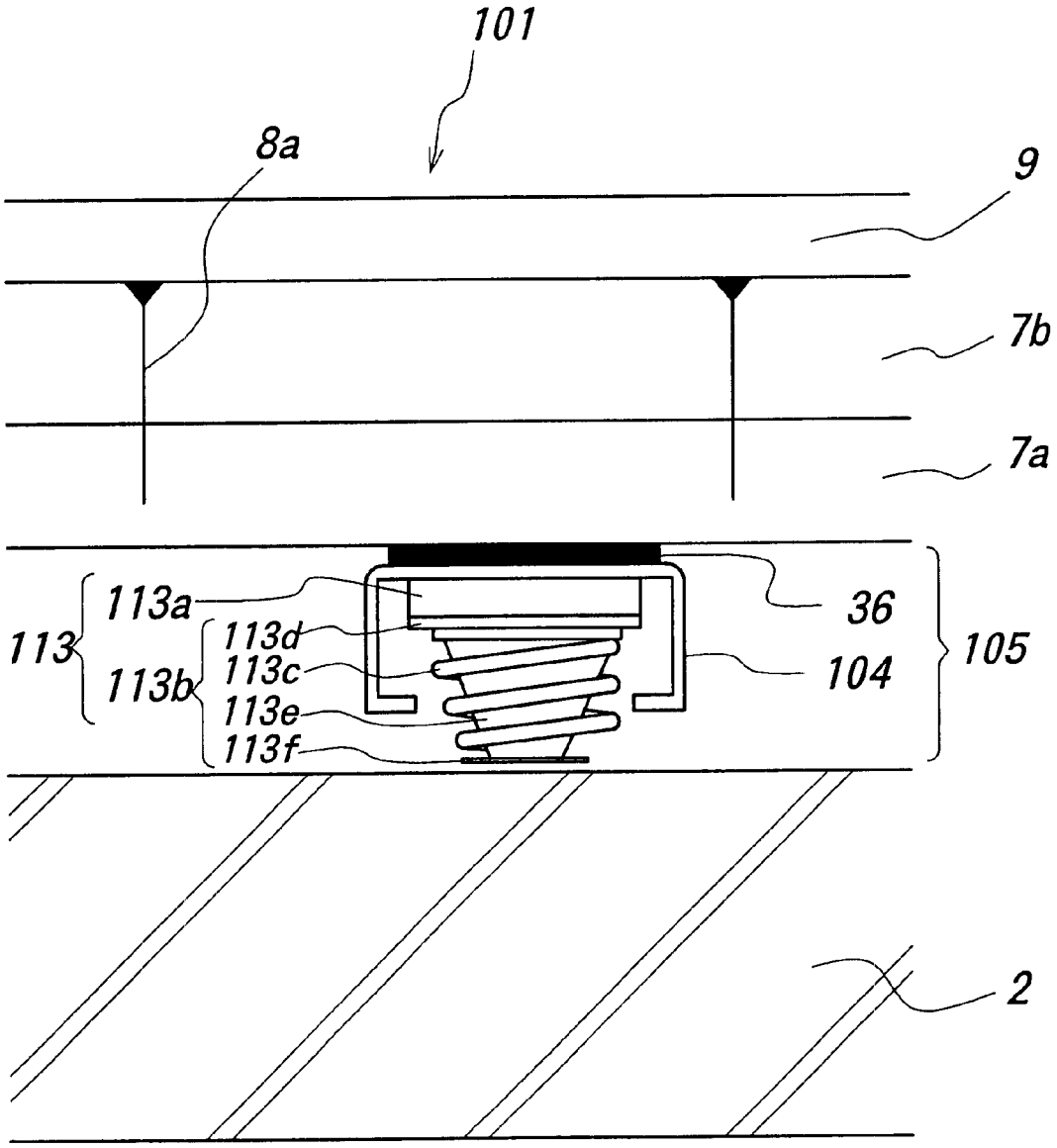
FIG. 13 is a partially sectional view of another portion of a sound-insulating floor member of FIG. 12.
Figure 14:
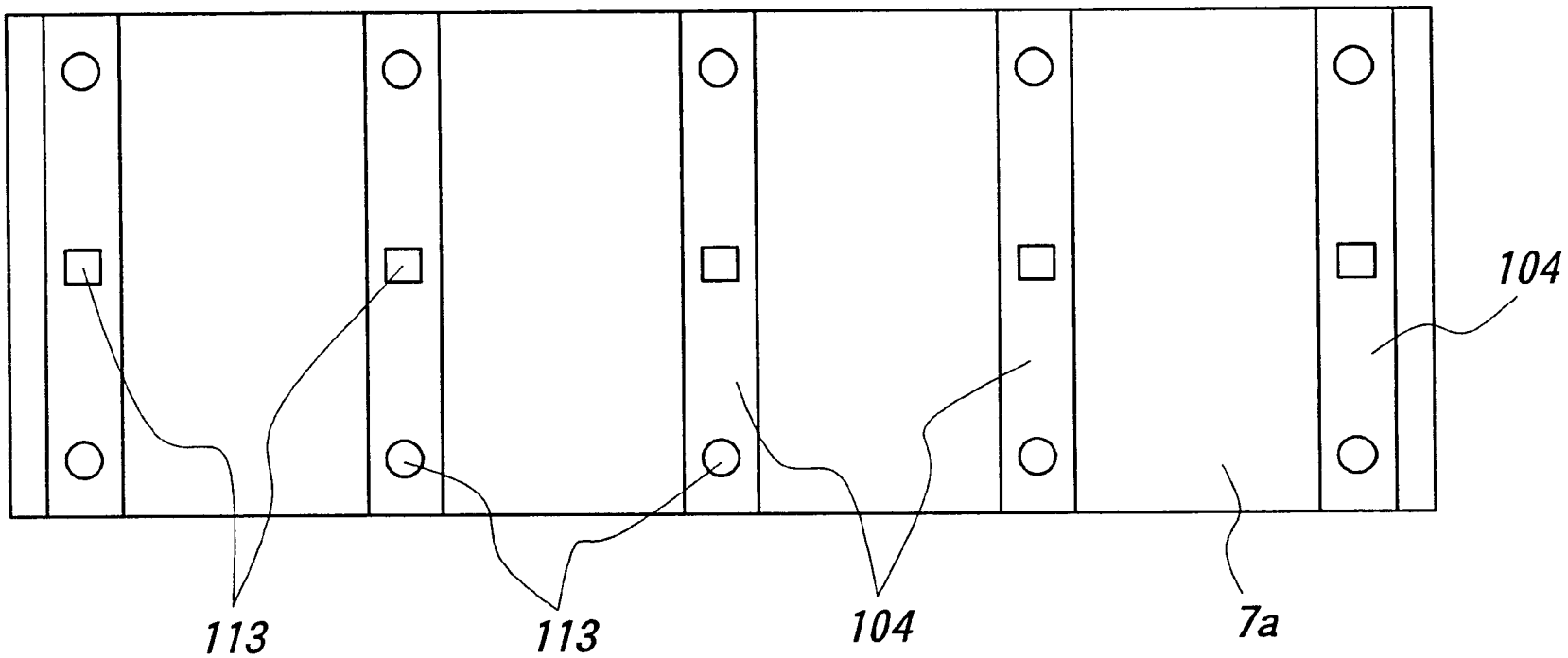
FIG. 14 is a back face view of sound-insulating floor members shown in FIGS. 12 and 13 as viewed from the lower side.

FIG. 12 is a partially sectional view of a still further embodiment of the sound-insulating floor structure according to the present invention. FIG. 13 is a partially sectional view of another portion of a sound-insulating floor member of FIG. 12. FIG. 14 is a back face view of sound-insulating floor members shown in FIGS. 12 and 13 as viewed from the lower side.

Figure 15:
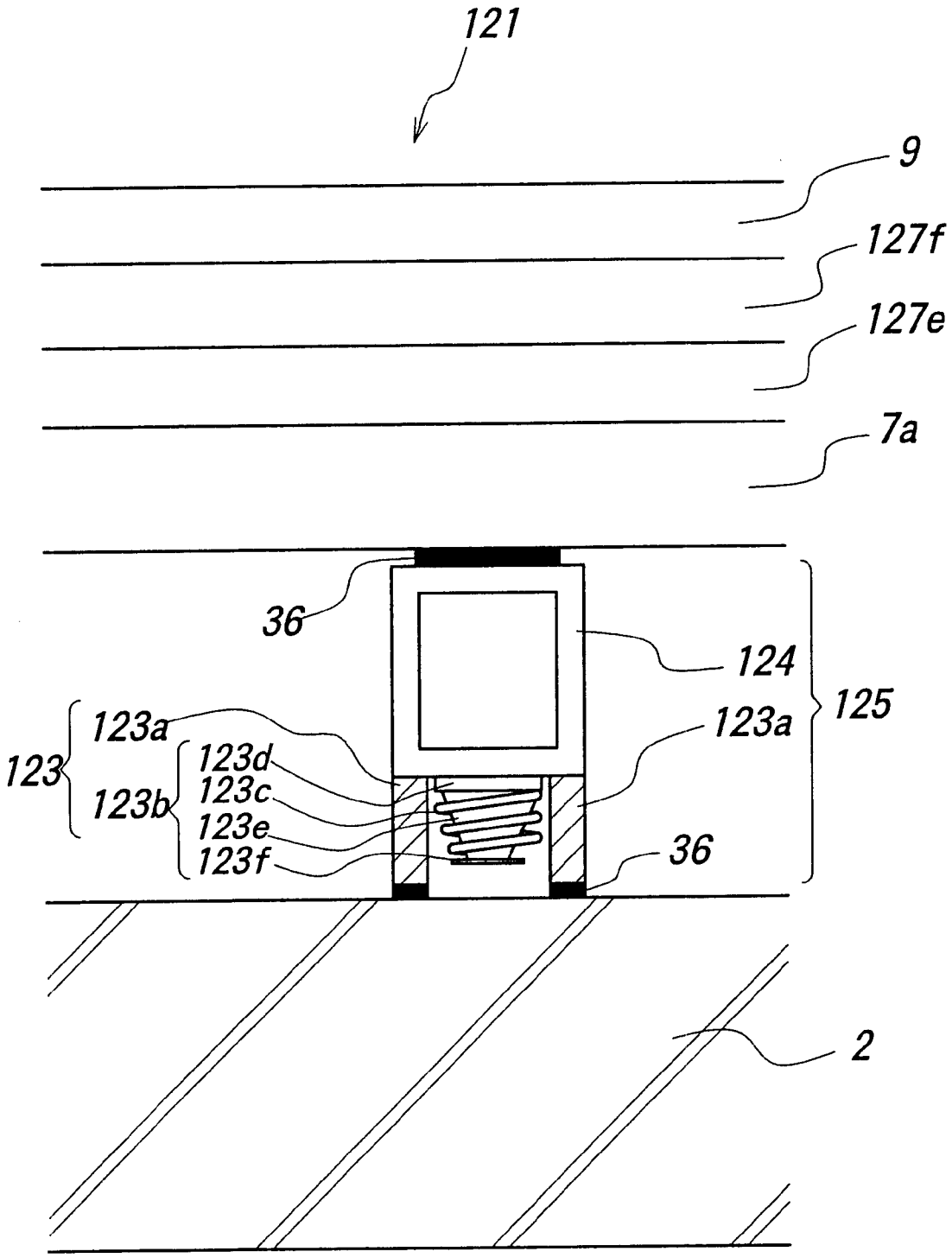
FIG. 15 is a partially sectional view of a still further embodiment of the sound-insulating floor structure according to the present invention.
Figure 16:
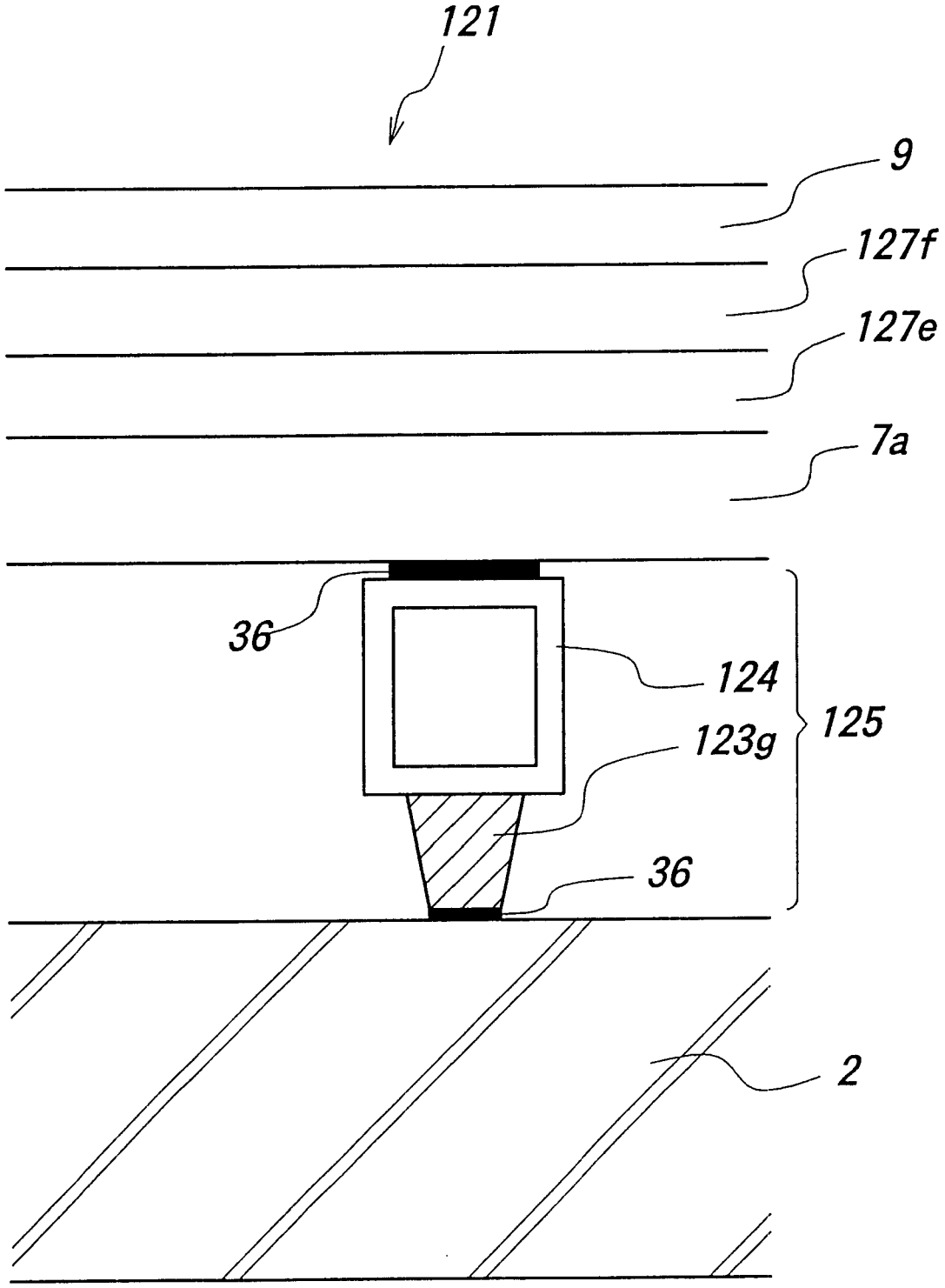
FIG. 16 is a partially sectional view of another portion of a sound-insulating floor member in FIG. 15.
Figure 17:
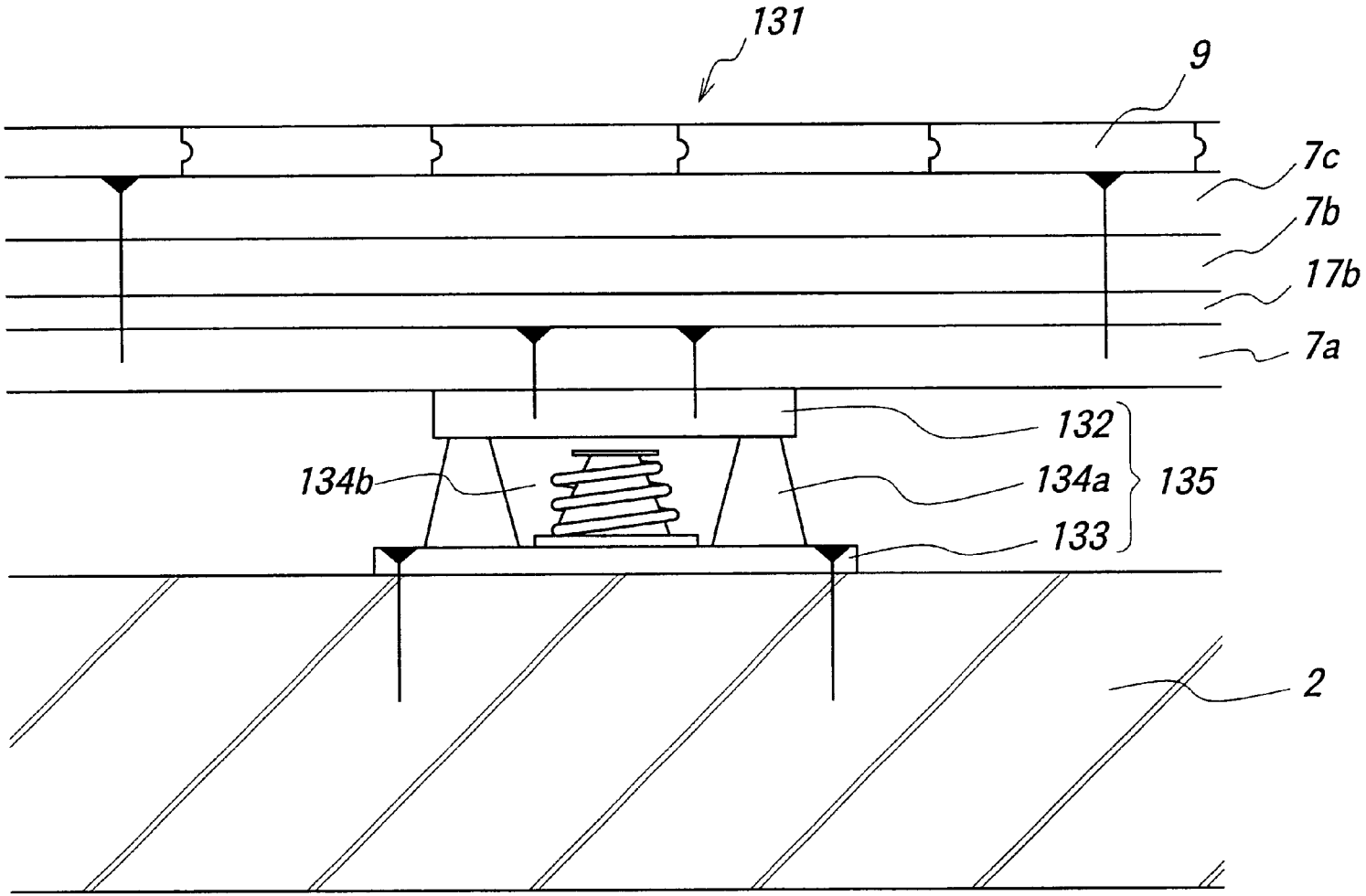
FIG. 17 is a partially sectional view of a still further embodiment of the sound-insulating floor structure according to the present invention in which impact-absorbing members are supported by support members having a shape other than a slender one.
Figure 18:
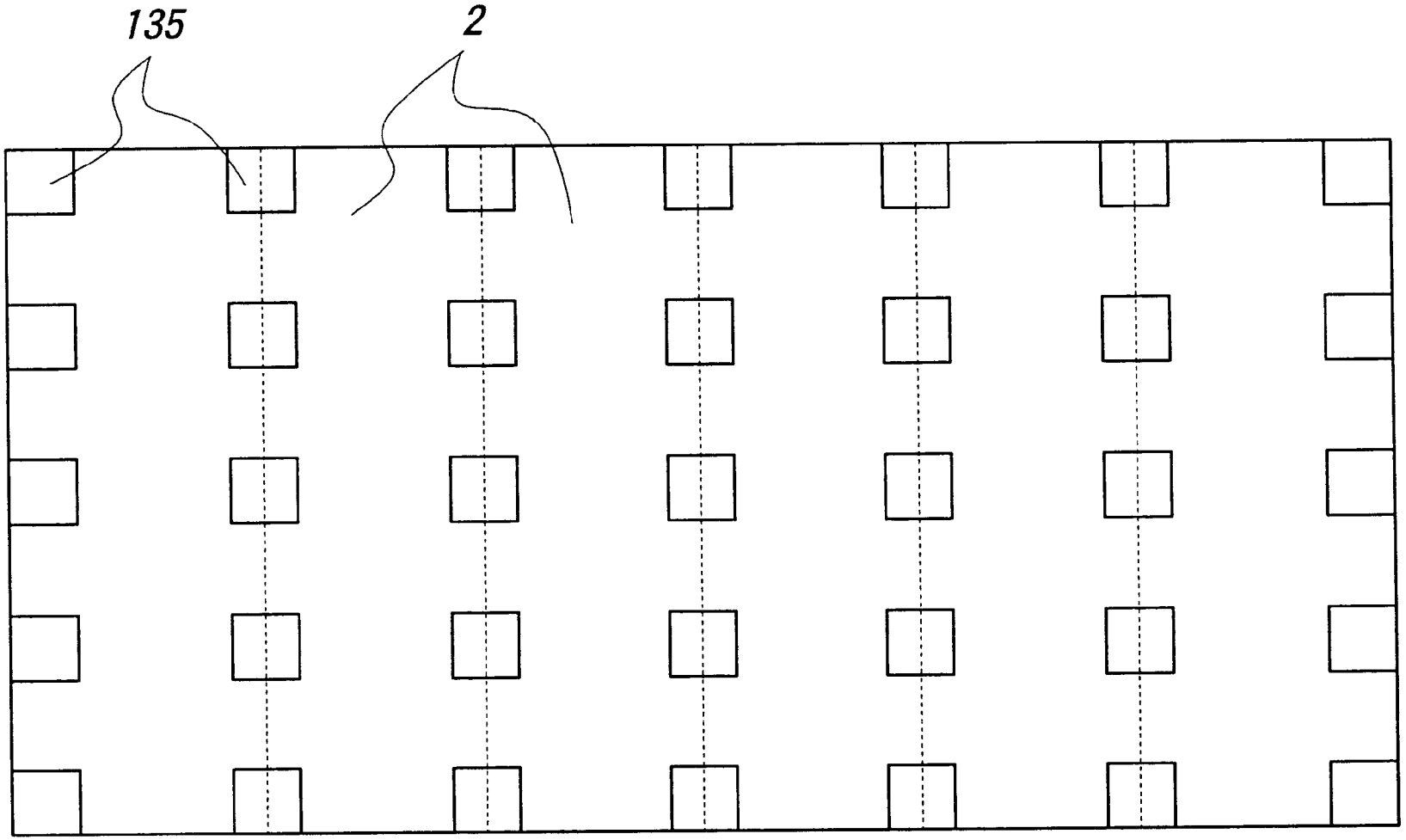
FIG. 18 is a plane view of sound-insulating floor members of FIG. 17 as viewed from a side of an underfloor member.

FIG. 15 is a partially sectional view of a still further embodiment of the sound-insulating floor structure according to the present invention. FIG. 16 is a partially sectional view of another portion of a sound-insulating floor member in FIG. 15. FIG. 17 is a partially sectional view of a still further embodiment of the sound-insulating floor structure according to the present invention. FIG. 18 is a plane view of sound-insulating floor members of FIG. 17 as viewed from a side of an underfloor member.

In the sound-insulating floor structure 1 shown in FIG. 1, sound-insulating floor members 5 are placed on a floor base 2, and constituted by frustuo-quadrangular pyramid-shaped impact-absorbing members 3 made of a cured material of liquid polybutadiene rubber and support members 4 such that a smaller area side of each of the impact-absorbing members 3 is directed downwardly, whereas a larger area side thereof is bonded to the support members 4. The sound-insulating floor members 5 are bonded to a particle board 7*a* of a underfloor member 7 with an acryl pressure-sensitive adhesive 6, two other particle boards 7*b* and 7*c* are laminated upon the particle board 7*a* such that a long side direction of the particle board 7*b* may be orthogonal to that of the particle board 7*c*. The particle boards are fixed with screws 8*a*, and a finish floor material 9 is fixed thereto with floor nails 8*b*.

FIG. 2 is a figure showing arrangement of the support members 4 upon the floor base at a floor opening side to which the sound-insulating floor members 5 in FIG. 1 are placed. Dotted lines denote seams between floor bases 2. The support members 4 each having a length almost equal to that of the floor base are arranged in parallel to the longitudinal direction of the floor bases 2, and five impact-absorbing members 3 are arranged at an equal pitch per one slender support member 4.

In the sound-insulating floor structure 11 shown in FIG. 3, impact-absorbing members 13*a* and 13*b* are arranged, at almost the same locations, above and under support members showing restraint type vibration controllability, at opposite end portions of a floor base 2, and the upper impact-absorbing member 13*b* is provided above an almost central portion of the lower impact-absorbing member 13*a*.

Plural impact-absorbing members 13*c* and 13*d* are arranged at other than the opposite end portions of the floor base 2 such that a lower impact-absorbing member 13*c* is provided at an almost center between upper impact-absorbing members 13*d*, whereby impacts may be absorbed by warping of the upper and lower impact-absorbing members 13*c* and 13*d* and the support members 14.

The support member 14 functions as a restrain type vibration-controlling member in which iron plates 14*b* are provided at opposite sides of a central viscoelastic body 14*a*. Small area sides of the impact-absorbing members 13*a*, 13*b*, 13*c* and 13*d* are directed to the support member 14.

In the sound-insulating floor structure 11 of FIG. 3, a vibration-controlling member 17*d* is used between particle boards 7*a* and 7*b* as a underfloor member, and the impact-absorbing members 13*a*, etc., the floor base 2 and the particle board 7*a* are fixed with the pressure-sensitive adhesive 6.

In the sound-insulating floor structure 21 shown in FIG. 4, sound-insulating floor members 25 are used. Impact-absorbing members 23 are made of rubber into which tire powder is so sealingly mixed that impacts may be absorbed by deformation of the rubbery powder, that of air among the rubbery powder and that of the sealing rubber.

The impact-absorbing members 23 are sandwiched between upper and lower slender support members 24, and four members 23 are arranged along the length of 1818 mm of the support members 24. The upper and lower support members 24, the floor base 2 and the particle board 7*a* of the underfloor member can be fixed with the acryl pressure-sensitive adhesive 6 by one-touch operation.

Three particle boards 7*a*, etc. are laminated on the support members 24 such that long sides of the boards are orthogonal to each other. The boards are fixed with screws 8*a*, and a flooring material of a finish floor material 9 is fixed thereto with floor screws 8*b*.

In the sound-insulating floor structure 31 shown in FIG. 5, sound-insulating floor members 35 are used. Totally three impact-absorbing members 33*a* made of a cured material of liquid polybutadiene with the pressure-sensitive reclaimed butyl rubber-based adhesive 34, which fixes the members 33*a* on the floor base 2, are provided on support members 34 each having a length of 1818 mm, at totally three locations, i.e., opposite end portions and a central portion thereof, and totally two impact-absorbing spring members 33*b* having a frusto-conical shape are provided between the impact-absorbing members 33*a*. Thus, totally five impact-absorbing members 33*a*, 33*b* are provided for one support member 34 (two of them are omitted in FIG. 5).

A seat 33*d* assuredly fixes the impact-absorbing member 33*b* of the frusto-conical spring 33*c*, a foam 33*e* is inserted into the spring to prevent contact sounds between spring turns, and a cap 33*f* is provided at a tip of the spring to prevent sounds which would be produced through contacting the floor base upon impacts.

In order to prevent the reciprocal vibration of the spring, the frusto-conical spring 33*c* is made slightly shorter than the cured member of the liquid polybutadiene so that the spring may contact the floor base 2 only upon receipt of the impacts.

The pressure-sensitive adhesive 36 made of a reclaimed butyl-based adhesive is provided only at locations where the support member 34 to which the impact-absorbing members 33*a*, 33*b* are fixed contacts the particle board 7*a* of the underfloor member.

The underfloor member comprises a particle board 7*a*, a gypsum board 37*e*, and a particle board 7*b* from the lower side such that their long sides may be orthogonal to each other and fixed with screws 8*a*.

In the sound-insulating floor structure 41 shown in FIG. 6, sound-insulating floor members 45 are used. Impact-absorbing members comprises three frusto-conical impact-absorbing members 43*a* of a height of 25 mm and two frusto-conical impact-absorbing members 43*b* of a height of 22 mm each made of a cured material of the liquid polybutadiene and fixed to a support member 44.

The 25 mm-high members 43*a* are located at opposite end portions and the central portions of the supporting member 44, whereas the 22 mm-high members 43*b* are arranged between the 25 mm-high members 43*a* (Two of the members are omitted in FIG. 6).

The reclaimed butyl rubber-based pressure-sensitive adhesive is provided at contacts between the 25 mm-high impact-absorbing members 43*a* and the floor base 2 and at contacts between the support member 44 and a particle board 7*a* of the underfloor member.

The underfloor member comprises the particle board 7*a*, a vibration-controlling, sound-insulating board 17*d* and two particle boards 7*b* and 7*c* laminated successively from the lower side, and the particle boards 7*a*, etc. are laminated and fixed with screws such that their long sides are orthogonal to each other. A flooring material of a finish floor member 9 is fixed with floor nails.

In the sound-insulating floor structure 51 shown in FIG. 7, sound-insulating floor members 55 are used. A support member 54 is designed as a restraint type vibration-controlling support member in which a viscoelastic body 54*b* having an aluminum foil as a restraint material is laminated upon an entire bent inner side of a lip groove-shaped steel 54*a*. Thereby, sound generation of the metallic support members upon impacts is prevented.

Five 25 mm-high frusto-conical impact-absorbing members 53 made of a cured material of the liquid polybutadiene are attached to the support member 54 having a length of 1800 mm. In FIG. 7, only one impact-absorbing member is shown to give a section of the support member 54.

A reclaimed butyl rubber-based pressure-sensitive adhesive 36 is provided at each of an upper portion of the support member 54 and under faces of the impact-absorbing members 53, the underfloor member is provided with screws 8*a* such that long side directions of two particle boards 7*a* and 7*b* are orthogonal to each other, and a flooring material of a finish floor member 9 is fixed thereto with floor nails 8*b*.

In the sound-insulating floor structure 61 shown in FIG. 8, sound-insulating floor members 65 are used. A support member 64 is a restraint type vibration-controlling support member 64 using a rectangular steel pipe 64*a* in which a viscoelastic body 64 having polyester films provided at opposite faces thereof as restraint material is bonded to each of opposite vertical faces of an inner space.

Totally four impact-absorbing members 63, which are each made of polynorbornene rubber in a frusto-quadrangular pyramid shape, are provided such that two are located at opposite ends of the support member 64 having 1800 mm, and two are to divide a distance between the former into three equal parts.

An upper portion of the support member 64 is fixed to a particle board 7*a* of an underfloor member with a pressure-sensitive adhesive 66, whereas a lower portion of the impact-absorbing member 63 is fixed to a floor base 2 with the reclaimed butyl rubber-based a pressure-sensitive adhesive.

The underfloor member above the support members 64 comprises two particle boards 7*a* and 7*b* which are laminated and fixed with screws such that their long side directions are orthogonal to each other. A flooring material of a finish floor member 9 is fixed to the underfloor member.

In the sound-insulating floor structure 71 shown in FIG. 9, sound-insulating floor members 75 are used. A support member 74 is a restraint type vibration-controlling support member comprising four planar restraint members 74*a* and viscoelastic bodies 74*b* alternatively arranged and laminated between them such that their laminating direction is orthogonal to a floor base.

An impact-absorbing member 73*a* made of a low foamed degree rubber is used at an upper portion of the support member 74, and totally five impact-absorbing members 73*b*, which are each made of EPT/butyl rubber in a frusto-quadrangular pyramid shape, are provided such that two are located at opposite ends of the support member 64 having 1818 mm, and three are to divide a distance between the former into four equal parts.

The reclaimed butyl rubber-based pressure-sensitive adhesive 36 is provided on the impact-absorbing member 73*a* at a side of the underfloor member 7*a* and the impact-absorbing member 73*b* at a side of a larger area side thereof, so that the impact-absorbing members are fixed to the particle board 7*a* of the underfloor member and the floor base 2.

Two particle boards 7*a* and 7*b* are laminated in the underfloor member such that their long side directions are orthogonal to each other, and a flooring material of a finish floor member 9 is fixed thereon with floor nails such that the long side direction of the particle boards is orthogonal to that of the flooring material.

In the sound-insulating floor structure 81 shown in FIG. 10, sound-insulating floor members 85 are used. A support member 84 is a restraint type vibration-controlling support member in which a viscoelastic body 84*b* is provided at a surface on a bent hollow space side of a lip groove-shaped steel 54*a*, and a foam 84*c* is filled in the hollow space to cover said surface.

Totally fiver impact-absorbing members are provided along a 1800 mm length of the support member 84, i.e., oily clay-filled rubber members (not shown) are fitted at opposite ends and a central portion of the support member, and two impact-absorbing members 83*a* which are each made of a cured product of the liquid polybutadiene rubber in a frusto-conical shape are provided between the adjacent oily clay-filled rubber members. The reclaimed butyl rubber-based pressure-sensitive adhesive 36 is provided at an upper portion of the support member 84 and a contact portion of the impact-absorbing member 83*a*, which are fixed to a particle board 7*a* of an underfloor member and the floor base 2, respectively.

Above the support members 84, two particle boards 7*a* and 7*b* are fixed with screws 8*a* such that their long sides are orthogonal to each other, and a finish floor member 9 is fixed thereto with floor nails.

In the sound-insulating floor structure 91 shown in FIG. 11, sound-insulating floor members 95 are used. A support member 94 is a vibration-controlling support member comprising a rectangular steel pipe 94*a* and a filler 94 of a mixture of a EPT foam powder and a tire powder in an inner hollow space thereof.

Four impact-absorbing members 93, which are each made of a foam-filled rubber, are provided per a 1800 mm length of the support member 94 at its opposite end portions and two points dividing a distance between the end portions into three equal parts. A pressure-sensitive adhesive 66 of the acryl pressure-sensitive adhesive is applied to an upper face of the support member 94, and the reclaimed butyl rubber-based pressure-sensitive adhesive is provided at an under face of the foam filled rubber of the impact-absorbing member 93.

Above the support members 94, two particle boards 7*a* and 7*b* are fixed with screws 8*a* such that their long sides are orthogonal to each other, and a flooring material of a finish flooring member 9 is fixed thereto with floor nails.

In the sound-insulating floor structure 101 shown in FIG. 12, sound-insulating floor members 105 are used. The sound-insulating floor member 105 comprises impact-absorbing members 113, under a support member 104, in which a polynorbornene rubber 103*a* and a cured product of the liquid polybutadiene 103*b* are arranged in series.

The sound-insulating floor structure 105 shown in FIG. 13 is provided with impact-absorbing members 113 formed by arranging a polynorbornene rubber 113 and a seat-provided frusto-conical spring 113*b* in series.

The support member 104 comprises a lip groove-shaped steel 54*a* having a lip portion downwardly faced, so that a bent hollow space is used as a space for arranging the impact-absorbing member 103, and the entire height of the sound-insulating floor member is not only lowered but also the bent rigid strength of the lip groove-shaped steel 54*a* is utilized.

The reclaimed butyl rubber pressure-sensitive adhesive 36 is provided at an upper portion of the support member 104 and a lower portion of the cured product of the liquid polybutadiene 103, which are fixed to the particle board 7*a* of the underfloor member and the floor base 2, respectively. Above the support members 54*a*, two particle boards 7*a* and 7*b* are fixed with screws 8*a* such that their long sides are orthogonal to each other, and a flooring material of the finish floor member 9 is fixed thereon with floor nails such that its long side is orthogonal to that of the particle board 7*b*.

The seat-provided frusto-conical spring 113 comprises a spring portion 113*c* slightly separated from the floor base 2, so that the spring serves to absorb impacts only upon receipt thereof. The other portions are the same as explained in connection with the impact-absorbing member shown in FIG. 5.

FIG. 14 is a view of the underfloor member 7*a* as viewed from a rear face side, showing a state in which these impact-absorbing members 103, 113 are provided at the support members 104.

In the sound-insulating floor structure 121 shown in FIG. 15, sound-insulating floor members 125 are used. Under a support member 124 is provided an impact-absorbing member 123 in which a seat-provided frusto-conical spring 123*b* is surrounded with a rectangular pipe-shaped rubber 123*a*. A spring 123*c* is supported by the rectangular pipe-shaped rubber 123*a* in the state that the spring is slightly spaced from the floor base 2.

The seat-provided frusto-conical spring 123*b* is the same as in the impact-absorbing members in FIGS. 5 and 13. An upper portion of the support member 124 is fixed to a particle board 7*a* with the reclaimed butyl rubber-based pressure-sensitive adhesive 36, and two laminate boards 127*e* and 127*f* and a flooring material of a finish floor member 9 are fixed such that their long sides are orthogonal to one another.

Sound-insulating floor members 125 are provided with impact-absorbing members 123*g* shown in FIG. 16. The impact-absorbing member 123*g* comprises a frusto-quadrangular pyramid shaped rubber under a support member 124. The other parts than the impact-absorbing member 123*g* are the same as in FIG. 15.

The present invention will be explained more concretely based on examples and comparative examples with reference to the drawings.

EXAMPLE 1

The sound-insulating floor structures shown in FIGS. 1 and 2 were constructed.

Support members were 5.5 mm thick×100 mm wide×1818 long. Impact-absorbing members were made of SRIS 01101C type hardness 10 of liquid polybutadiene with a 60×60 mm square bottom face, a 30×30 mm square upper face and a height of 25 mm. Five impact-absorbing members were fixedly bonded to the support member at an equal pitch.

Onto an upper face of the support member was bonded a 10-fold foamed body having a thickness of 1 mm and 80 mm width and 1818 length and coated with an acrylic pressure-sensitive adhesive at opposite faces, and a protective release film was attached to the other face of the foamed body.

Six ALC floor bases were installed, via vibration-controlling rubber sheets being 6 mm thick, 40 mm wide and 3.6 m long, at openings of H-steel beams being 200 mm high×100 mm wide with a horizontal thickness of 15 mm and a vertical thickness of 4 mm.

Next, the protective release films were removed form the upper faces of each of totally three support members attached with the impact-absorbing members, and the three support members were bonded to a particle board as an underfloor member having 20 mm thickness, 606 mm width and 1818 length along its long side direction at a central portion in a short side direction and locations spaced inwardly from opposite ends by 100 mm. The support members were placed on the entire faces of the six ALC floor bases such that the long side direction of the ALC floor bases were aligned with that of the particle boards.

Next, other particle boards being 9 mm thick×909 wide×20 mm long were placed on the 20 mm-thick particle boards such that the former were orthogonal to the latter, and further particle boards being 9 mm thick×909 width×1818 mm long were placed on said other particle boards such the latter were orthogonal to the former having the thickness of 9 mm, and the latter were fixed to the 20 mm-thick lower ones with screws.

Next, flooring materials being 12 mm thick, 300 mm wide and 1818 mm long were fixed as a finish floor member to the 15 mm thick particle boards with screws such that the former were orthogonal to the latter. Then, heavy floor impact sounds were measured. Displacements of the floor were measured at five locations under floor loads of 60, 80 and 120 kg. Results are shown in Table 1.

EXAMPLE 2

The sound-insulating floor structure shown in FIG. 3 was constructed.

As support members, restraint type vibration-controlling support members in which the liquid polybutadiene rubber was cured by crosslinking between two iron plates being 1.6 mm thick×100 mm wide×1818 long were used, and impact-absorbing members made of polynorbornene rubber and having JIS-A hardness of 40 were fixedly bonded to upper and lower side of each support member. That is, four impact-absorbing members having a 50-mm diameter under face, a 30-mm diameter upper face and a 15-mm height were fixedly bonded to the lower side of the support member at an equal interval, whereas five impact-absorbing members having a 40-mm diameter under face, a 30-mm diameter upper face and a 10-mm height were fixedly bonded to the upper side of the support member at an equal interval. The impact-absorbing members at opposite end portions at the upper side of the support member were located at the same locations as those on the lower side, whereas the other three impact-absorbing members were located between the adjacent impact-absorbing members at the lower side. The smaller diameter side of each impact-absorbing member was bonded to the support member, and the remaining larger diameter side was bonded with the reclaimed butyl rubber-based pressure-sensitive adhesive, thereby forming the support member with the impact-absorbing members.

In the same way as in Example 1, construction was effected with respect to ALC floor bases. Totally three support members with the impact-absorbing members were bonded to a particle board being 20 mm thick×606 mm wide×1818 mm long along its long side direction at a central portion of its short side and two locations spaced from opposite ends of the particle board by 100 mm. Construction was effected in the state that the long side direction of the ALC floor bases was aligned with that of the particle boards.

Next, vibration-controlling and sound-insulating members having a specific gravity of 3.0 and 0.6 mm thickness× 455 mm width×910 mm length were placed on the entire upper face of the particle boards, and then other particle boards having 115 mm thickness×909 mm width×1818 mm length were placed and screw-fixed to the 20 mm-thick particle boards such that the long side direction of the former was orthogonal to that of the latter.

Next, flooring materials having 12 mm thickness×300 mm width×1818 mm length were fixed to the 15 mm-thick particle boards such that the long sides of the former were orthogonal to those of the latter.

Heavy floor impact sounds were measured, and then displacement amounts were measured under floor loads of 60 kg, 80 kg and 120 kg. Results are shown in Table 1.

EXAMPLE 3

The sound-insulating floor structure of FIG. 4 was constructed.

Laminate boards having 5.5 mm thickness×100 mm width×1818 mm length and other laminate board having 3 mm thickness×100 mm width×1818 mm length were used as upper and lower support members, respectively, and four impact-absorbing members were fixedly bonded to the support members at an equal interval. Each impact-absorbing member was made of butyl rubber having JIS-A hardness of 35, and had a 70-mm square lower face, a 50-mm square upper face, an upper rubber thickness of 5 mm, a lower rubber thickness of 5 mm, a peripheral rubber thickness of 10 mm and a height of 25 mm, and 20 mesh tire powder was sealed into the impact-absorbing member.

The upper and lower support members had 5.5 mm and 3 mm thicknesses, respectively. A foamed polyethylene body having the acryl pressure-sensitive adhesive at opposite faces as used in Example 1 was bonded to each of the upper and lower support members.

ALC floor bases as used in Example 1 were used, and the support members were attached to particle boards having 20 mm thickness×606 mm width×1818 mm length along a long side direction at locations spaced inwardly from opposite ends in a short side direction by 150 mm such that the long side direction of the particle boards is orthogonal to that of the ALC floor bases, then other particle boards having 9 mm thickness×909 mm width×1818 mm length were placed on the 20 mm-thick particle boards such that their long side directions were orthogonal to each other. Thereafter, further particle boards having 15 mm thickness×909 mm width× 1818 mm length were placed and screw-fixed onto the 9 mm-thick particle boards such that their long side directions were orthogonal to each other.

Flooring materials (12 mm thickness×303 mm width× 1818 mm length) were fixed as a finish floor member to the 15 mm-thick particle boards with floor nails such that their longitudinal directions were orthogonal to each other.

Heavy weight floor impact sounds were measured, and displacement amounts were measured under floor loads of 60 kg, 80 kg and 120 kg. Results are shown in Table 1.

EXAMPLE 4

The sound-insulating floor structure of FIG. 5 was constructed. As support members, laminate plates having 5.5 mm thickness×100 mm width×1818 mm length were used, and cured bodies of the liquid polybutadiene having SRIS 0101C type hardness of 10 were used as impact-absorbing members. Three impact-absorbing members having a 46-mm-lower face, a 23-mm diameter upper face and a 25-mm height were bonded to the support member at opposite ends and a central portion thereof. Two 23 mm-high impact-absorbing members were fixed at central portions between locations attached with the above liquid polybutadiene cured bodies with the adhesive and screws. These two impact-absorbing members were each obtained by inserting a foam into a frusto-conical spring having a 40 mm-diameter lower face, a 20 mm-diameter upper face and a wire diameter of 3.5 mm, fixing the spring to a seat base of an iron plate having 0.8 mm thickens×50 mm square, and attaching a 1 m-thick polyethylene cap to an upper face of the spring.

The reclaimed butyl rubber-based pressure-sensitive adhesive having a 80 mm square and 1 mm thickness was bonded to the upper face of he support member at each of locations where the liquid polybutadiene cured products and the frusto-conical springs were installed, and only the liquid polybutadiene cured products were bonded with the 1 mm-thick reclaimed butyl rubber-based adhesive for fixing them to the floor base.

The support members to which two kinds of, totally five, impact-absorbing members were attached were bonded to a particle board having 20 mm thickness×606 mm thickness× 1818 mm length along a long side direction at a central portion in a short side direction and locations spaced inwardly from end portions of the particle board by 100 mm.

The resultant was fixed to the same ALC floor bases as used in Example 3 along its long side direction such that the longitudinal direction of the ALC floor bases was orthogonal to that of the 20 mm-thick particle boards, a gypsum board having 12 mm thickness×909 mm width×1818 mm length was placed and fixed with screws onto the lower 20 mm-thick particle boards.

Next, flooring materials as a finish floor member having 12 mm thickness×303 mm width×1818 length were fixed to the 20 mm-thick particle boards such that the long side direction of the former was orthogonal to that of the latter.

Heavy weight floor impact sounds were measured, and displacement amounts were measured under floor loads of 60 kg, 80 kg and 120 kg. Results are shown in Table 1.

EXAMPLE 5

The sound-insulating floor structure shown in FIG. 6 was constructed.

As the support members, restraint type vibration-controlling support members were each prepared by integrally bonding two laminate plates having 5.5 mm thickness×100 mm width×1818 mm length with a 1 mm-thick crosslinked product of the liquid polybutadiene.

Three impact-absorbing members made of cured products of the liquid polybutadiene having SRIS 0101C type hardness 30 and having a 46 mm-diameter lower face, a 23 mm-diameter upper face and a 25-mm thick were fixedly bonded to opposite ends and a central portion of the support member, and totally two impact-absorbing members made of cured products of the same liquid polybutadiene having SRIS 0101C type hardness 30 and having a 46 mm-diameter lower face, a 25.8 mm-diameter upper face and a 22-mm thickness were each fixedly bonded to a central portion of the adjacent above impact-absorbing members.

A 1 mm-thick reclaimed butyl rubber-based pressure-sensitive adhesive was attached to the support member on a side of the underfloor member over an area having 80 mm width and 1800 mm length, that reclaimed butyl-based pressure-sensitive adhesive was attached at 1 mm thickness and 20 mm square to only the 25 mm-height impact-absorbing members at the opposite ends and the central portions only on a side of the ALC floor base.

Totally three impact-absorbing members were bonded to a particle board having 20 mm thickness×606 mm width×1818 length along its long side direction at a central portion and locations inwardly spaced by 100 mm from opposite ends in a short side direction thereof, and the resultant was turned over and fixed to the ALC floor bases such that the long side direction of the ALC floor bases was orthogonal to that of the 20 mm-thick particle board.

Next, vibration-controlling and sound-insulating plates having a specific gravity of 3.0 and 0.6 mm thickness×455 mm width×910 mm length were placed over the entire face of the resultant, and particle boards having 9 mm thickness×909 width×1818 mm length and other particle boards having 15 mm thickens×909 width×1818 mm length were placed on the underlying particle boards such that the long side direction of the former was orthogonal to that of the latter. The 20 mm-thick particle boards was fixed to the 15 mm particles board with screws.

Next, flooring materials having 12 mm thickness×303 mm width×1818 mm length were fixed to the 15 mm-thick particle boards with floor nails such that the longitudinal direction of the former was orthogonal to that of the latter.

Heavy weight floor impact sounds were measured, and displacement amounts were measured under floor loads of 60 kg, 80 kg and 120 kg. Results are shown in Table 1.

EXAMPLE 6

The sound-insulating floor structure of FIG. 7 was constructed.

As the support members, restraint type vibration-controlling support members were prepared in which a 2 mm-thick butyl rubber-based viscoelastic body with a 100 μm-thick aluminum foil on one side was bonded to an entire face of a bent inner side of a lip groove-shaped H-steel of an ordinary structure light-weight steel having 100 mm height×50 mm width×20 mm lip×1.6 mm thick×1800 mm length.

Next, five of the same impact-absorbing members as used in Example 4 and made of cured products of the liquid polybutadiene having a 46 mm-diameter lower face, a 23 mm-diameter upper face and a 25 mm-height with SRIS 0101C type hardness 10 were attached to the support member at an equal interval, thereby preparing the support member attached with the impact-absorbing members. Thereafter, 1 mm-thick reclaimed butyl rubber-based pressure-sensitive adhesive was applied to each of upper faces of the support members and lower faces of the impact-absorbing members.

Two support members with the impact-absorbing members were attached to a particle board having 20 mm thickness×606 mm width×1818 mm length along its longitudinal direction at locations spaced inwardly from opposite ends of the particle board by 150 mm such that the long side direction of the particle boards was orthogonal to that of the ALC floor bases.

Next, other particle boards having 20 mm thick×606 mm width×1818 mm length were placed and fixed with screws onto the underlying particle boards such that their long side directions were orthogonal to each other.

Then, flooring materials having 12 mm thickness×303 mm width×1818 mm length were fixed thereto with floor nails. The flooring materials were fixed in such a direction that a long side direction of the flooring materials was orthogonal to that of the particle diameter.

Heavy weight floor impact sounds were measured, and displacement amounts were measured under floor loads of 60 kg, 80 kg and 120 kg. Results are shown in Table 2.

EXAMPLE 7

The sound-insulating floor structure of FIG. 8 was constructed.

As supporting members, ordinary structural rectangular steel pipes having 100 mm height×50 mm width×1.6 mm thickness were used, and restraint type vibration-controlling support members were prepared by bonding 50 μm-thick polyester film-attached reclaimed butyl rubber-based viscoelastic body having 2 mm thickness×70 mm width×1800 mm length to opposite vertical inner faces of a hollow space of the steel pipe.

Four impact-absorbing members, which had the same composition as that of the polynorbornene rubber as used in Example 2 with a frusto-quadrangular pyramid shape having a 40 mm-square lower face, a 20 mm-square upper face and a 25-mm height, were fixedly bonded to the support member at an equal interval.

The same sheet as used in Example 1 having the acryl pressure-sensitive adhesive coated on opposite faces of a polyethylene foam was bonded to an upper face of the restraint type vibration-controlling support member over an area of 40 mm width and 1800 mm length. The reclaimed butyl rubber-based pressure-sensitive adhesive was applied to surfaces of the impact-absorbing members which were to be installed on the floor bases.

The restraint type vibration-controlling support members with the impact-absorbing members were bonded to a particle board having 20 mm thickness×606 mm width×1818 mm length in its longitudinal direction at locations spaced inwardly from opposite ends of the particle board in its short side direction by 150 mm.

The particle boards was turned over and fixed to ALC floor plates such that the long sides of the ALC floor plates were orthogonal to the long side of the particle boards, and other particle boards having 20 mm thickness×606 mm width×1818 mm length and flooring materials as a finish floor member having 12 mm thickness×606 mm width×1818 mm length were successively fixed thereto with screws and floor nails, respectively.

Heavy weight floor impact sounds were measured, and displacement amounts were measured under floor loads of 60 kg, 80 kg and 120 kg. Results are shown in Table 2.

EXAMPLE 8

The sound-insulating floor structure of FIG. 9 was constructed.

Restraint type vibration-controlling support members each having 51 mm thickness×80 mm width×1818 mm length were each prepared by alternatively laminating four laminate plate units each having 12 mm thickness×80 mm width×1818 mm length with the liquid polybutadiene viscoelastic bodies through a curing reaction.

Five impact-absorbing members were fixedly bonded to upper and lower sides such that the viscoelastic bodies and the support member units of the above restraint type vibration-controlling support member would be orthogonal to floor bases and underfloor members. The impact-absorbing members each comprised an upper impact-absorbing material of a EPT/IIR rubber body, with a low foamed degree, having 5 mm thickness×50 mm width×1818 mm length and a lower impact-absorbing material of a EPT/butyl rubber having a 40 mm-square lower face, a 20 mm-square upper face and a 25-mm height with A-hardness of 30, and were fixedly bonded at an equal interval.

The entire upper faces of the rubber low foamed bodies were provided with the reclaimed butyl rubber-based pressure-sensitive adhesive in a thickness of 0.5 mm. Faces of the EPT/butyl rubber members which were to be installed on a floor base were provided with the reclaimed butyl rubber-based pressure-sensitive adhesive in a thickness of 1 mm.

The support members were bonded to a particle board having 20 mm thickness×606 mm width×1818 mm length in a direction parallel to the longitudinal direction of the particle board at locations spaced inwardly from opposite ends of its short sides by 150 mm. The particle board was turned over and fixed to ALC floor bases such that the longitudinal direction of the particle boards was orthogonal to that of the ALC floor bases.

Onto the resulting laminate were placed and further screw-fixed another particle boards having 20 mm thick× 606 mm width×1818 mm length, and flooring materials as a finish floor member having 12 mm thickness—303 mm width×1818 mm length were fixed the particle board with floor nails. The underfloor members and the finish floor member were laminated such that their long sides were orthogonal to the underlying board.

Heavy weight floor impact sounds were measured, and displacement amounts were measured under floor loads of 60 kg, 80 kg and 120 kg. Results are shown in Table 2.

EXAMPLE 9

The sound-insulating floor structure of FIG. 10 was constructed.

As support members, lip groove-shaped steels having 100 mm height×50 mm width×20 mm lip×1.6 mm thickness× 1800 mm length and made of an ordinary structural light weight steel were prepared, and a butyl rubber-based damping material having a specific gravity of 2.8 and a thickness of 4 mm was bonded to the entire inner surface of a bent inner portion of each steel and an EPT foam was filled in a remaining hollow space.

As impact-absorbing members, three oily clay-filled NRB members each having 45 mm width×100 mm length×30 mm height with upper and lower face rubber thickness of 5 mm and a peripheral rubber thickness of 8 mm and a rubber hardness A 50 and two cured bodies of the liquid polybutadiene having a 46 mm-diameter lower face, a 18.4 mm-diameter upper face and a 30-mm height with SRIS 01010C type hardness 30 were prepared. The oily clay-filled NBR members were fixedly bonded to a central portion and opposite ends of the support member, and the liquid polybutadiene-cured bodies were fixedly bonded thereto between the oily clay-filled NBR members.

The reclaimed butyl rubber-based pressure-sensitive adhesive was applied in a size of 40 mm width×1800 mm length×1 mm thickness to an upper face of the support member, and the reclaimed butyl rubber-based pressure-sensitive adhesive was applied to locations of the oily clay-filled NBR members at a side to which the ALC floor plates were attached. The support members were bonded to a particle boards as an underfloor member having 20 mm thickness×606 mm width×1818 mm length along its longitudinal direction at a central portion and locations spaced inwardly from opposite ends of its short sides by 100 mm.

These underfloor member were turned over, and fixed such that the longitudinal direction of the underfloor member were orthogonal to that of the ALC floor bases. A particle board having 20 mm thickness×606 mm width×1818 mm length was screw-fixed to the underfloor member such that the longitudinal direction of the particle board was orthogonal to that of the underfloor member. Flooring material of a finish floor member having 12 mm thickness×303 mm width×1818 mm length were fixed to the underfloor members with floor nails such that the longitudinal direction of the flooring material was orthogonal to that of the particle board.

Heavy weight floor impact sounds were measured, and displacement amounts were measured under floor loads of 60 kg, 80 kg and 120 kg. Results are shown in Table 2.

EXAMPLE 10

The sound-insulating floor structure of FIG. 11 was constructed.

As supporting members, ordinary structure shape steel pipes having 100 mm height×50 mm width×1.6 mm plate thickness and 1800 mm length were used, a mixture of EPT foam powder and tire powder was filled in a hollow space inside the steel pipe, and its opposite ends were plugged with rubber.

The same polyethylene foam having acryl pressure-sensitive adhesive applied to opposite faces as used in Example 1 was pasted to an upper face of the support member over 40 mm width and 1800 mm length.

As impact-absorbing members, foam-filled rubber parts having 45 mm width×100 mm length×30 mm height with upper and lower rubber thickness of 5 mm and peripheral rubber thickness of 8 mm were prepared. The surrounding rubber has rubber hardness A 50. These parts were fixedly bonded to the support member at opposite ends and two intermediate locations at an equal interval. The reclaimed butyl rubber-based pressure-sensitive adhesive was pasted 1 mm thick to a face of the foam-filled rubber which was to be placed on a floor base.

Two support members were fixed to particle board having 20 mm thickness×606 mm width×1818 mm length as an underfloor member such that the support members were in parallel with the longitudinal direction of the particle boards at locations inwardly spaced from opposite sides thereof in a short side direction, and other particle board having 12 mm thickness×303 mm width×1818 mm length were fixed to the former with screws such that their longitudinal directions were orthogonal to each other. Then, flooring materials as a finish floor member having 12 mm thickness×303 mm width×1818 mm length were fixed to the above laminate such that the longitudinal direction of the flooring materials was orthogonal to that of the particle boards.

Heavy weight floor impact sounds were measured, and displacement amounts were measured under floor loads of 60 kg, 80 kg and 120 kg. Results are shown in Table 2.

EXAMPLE 11

The sound-insulating floor structures shown in FIGS. 12 to 14 were constructed.

As support members, lip groove-shaped steels having 60 mm height×30 mm width×10 mm lip×1.6 mm plate thickness×600 mm length and made of an ordinary structural light weight steel were used, while their lid portions were directed to floor bases to give a height of 30 mm and a width of 60 mm. The upper face of the support member had 60 mm width, and the reclaimed butyl rubber-based pressure sensitive adhesive was pasted in 1 mm thick onto the upper face over 50 mm width and 600 mm length.

Two impact-absorbing members were fixedly bonded to a hollow space side of the lip groove-shaped steel. The impact-absorbing member was prepared by bonding a 46 mm-diameter punched body from a 15 mm polynorbornene rubber sheet with a JIS A-hardness 40 to a cured product of the liquid butadiene having a 46 mm-diameter lower face, a 23 mm-diameter upper face and a 25-mm height with SRIS 0101C type hardness 10.

Next, a 50-mm square of the above 15 mm-thick polynorbornene rubber sheet having JIS A-hardness 40 was bonded to a seat attached to a frusto-conical spring as used in Example 4, and this one spring was fixedly bonded to a central portion of the lip groove-shaped steel on the follow space side. The 20 mm-square, 1 mm-thick butyl rubber-based pressure-sensitive adhesive was pasted on portions of a floor base where the liquid polybutadiene-cured products were to be installed.

Five support members were bonded to one particle board as an underfloor member having 20 mm thickness×606 mm width×1818 mm length such that three support members were fixed at a central portion and locations spaced inwardly from opposite ends of the longitudinal sides by 100 mm in a direction parallel to the short sides of the particle board, two being each located between the adjacent support members as referred to above. The resultant was bonded to ALC floor bases such that the long sides of the particle boards were in parallel to those of the ALC floor bases. Other particle boards having 20 mm thickness×606 mm width×1818 mm length were fixed to the laminate with screws such that the longitudinal directions of the particle boards were orthogonal to each other. Flooring materials having 12 mm thickness×303 mm width×1818 mm length as a finish floor material were fixed to the above particle boards with floor nails.

Heavy weight floor impact sounds were measured, and displacement amounts were measured under floor loads of 60 kg, 80 kg and 120 kg. Results are shown in Table 3.

EXAMPLE 12

The sound-insulating floor structures shown in FIGS. 15 and 16 were constructed.

As waste plastic rectangular pipes (70 mm height×70 mm width×600 mm length, hollow space: 50 mm height×50 mm width×600 mm length) were used, the reclaimed butyl rubber-based pressure-sensitive adhesive was pasted in a size of 0.5 mm thickness×50 mm width×600 mm length upon an upper face of each pipe, thereby obtaining support members.

One impact-absorbing member was provided at a central portion of the support member. This impact-absorbing member was prepared by covering an outer periphery of a seat-provided frusto-conical spring (same as in Example 4) having 50 mm square×23 mm height with a rectangular pipe made of EPT rubber (outer dimensions: 70 mm×70 mm×25 mm height, inner dimensions 55 mm×55 mm×25 mm height).

Frusto-quandrangular pyramid-shaped rubber parts made of PPT/IIR rubber with 40 mm square/20 mm square/25 mm height as used in Example 8 were bonded at a 40 mm-square side to end portions of the support member. The reclaimed butyl rubber-based pressure-sensitive adhesive was pasted on the 20 mm square side of each of the support members.

Five above impact-absorbing members were bonded to particle boards each having 20 mm thickness×606 mm width×1818 mm length in parallel to short sides thereof at a central portion and locations spaced inwardly from opposite ends of the particle board by 100 mm.

The above particle boards were turned over and fixed such that the longitudinal direction of the particle boards was orthogonal to that of the floor bases. Two laminate plates each having 12 mm thickness×909 mm width×1818 mm length were successively laminated and screw-fixed to the particle board such that the longitudinal directions thereof were orthogonal to each other. Flooring materials having 12 mm thickness×303 mm width×1818 mm length was fixed thereto with floor nails such that the longitudinal directions thereof were orthogonal to that of the particle boards.

Heavy weight floor impact sounds were measured, and displacement amounts were measured under floor loads of 60 kg, 80 kg and 120 kg. Results are shown in Table 3.

EXAMPLE 13

The floor structures shown in FIGS. 17 and 18 were constructed. FIG. 17 is a partially sectional view of the floor structure 131 in which impact-absorbing members are supported by upper and lower support members. FIG. 18 is a plane view of the floor member of FIG. 17 as viewed from an underfloor member side.

A floor member 135 was used in which the impact-absorbing members 134*a* and 134*b* were provided between the upper and lower plates 132 and 133, and the lower plate 133 were fixed to a floor base with screws. The upper plate 132 was fixed to a particle board of an underfloor member 7*a* with screws, on which a vibration-controlling and sound-insulating plate 17*d*, two particle boards 7*b*, 7*c* and a flooring material of a finish floor member 9 were successively fixed such that their long sides were alternatively orthogonal to one another.

Cured bodies of the liquid polybutadiene each having 40 mm square/20 mm square×25 mm height were placed at four corners between an upper plate laminate (9 mm×225 mm) and a lower plate laminate (5.5 mm thickness×300 mm square), and a 23 mm-high frusto-conical spring with 40 mm diameter/20 mm diameter having a 50 mm-square iron plate as a seat, which was fixed to the lower plate with screws. The floor member was prepared by bonding the liquid polybutadiene cured products to the upper and lower laminate plates with the adhesive.

Such floor members were fixed to floor bases with DAC screws at a pitch of 600 mm in a short side direction and at a pitch of 455 mm in a long side direction as measured from center to center, and further particle boards having 20 mm thickness×909 width×1818 mm length were placed on the laminate and screw-fixed onto the floor members such that the particle boards was orthogonal to the floor boards.

Then, vibration-controlling and sound-insulating materials having a specific gravity of 3.0 and 0.6 mm thickness×455 mm width×910 mm length were paved on the entire face of the resultant, and particle boards having 9 mm thickness× 909 mm width×1818 mm length, further particle boards having 15 mm thickness×909 mm×1818 mm length and flooring materials having 12 mm thickness×303 mm width× 1818 mm length were fixed to the resulting laminate such that their long sides were alternatively made orthogonal.

Heavy weight floor impact sounds were measured, and displacement amounts were measured under floor loads of 60 kg, 80 kg and 120 kg. Results are shown in Table 3.

COMPARATIVE EXAMPLE 1

Figure 19:
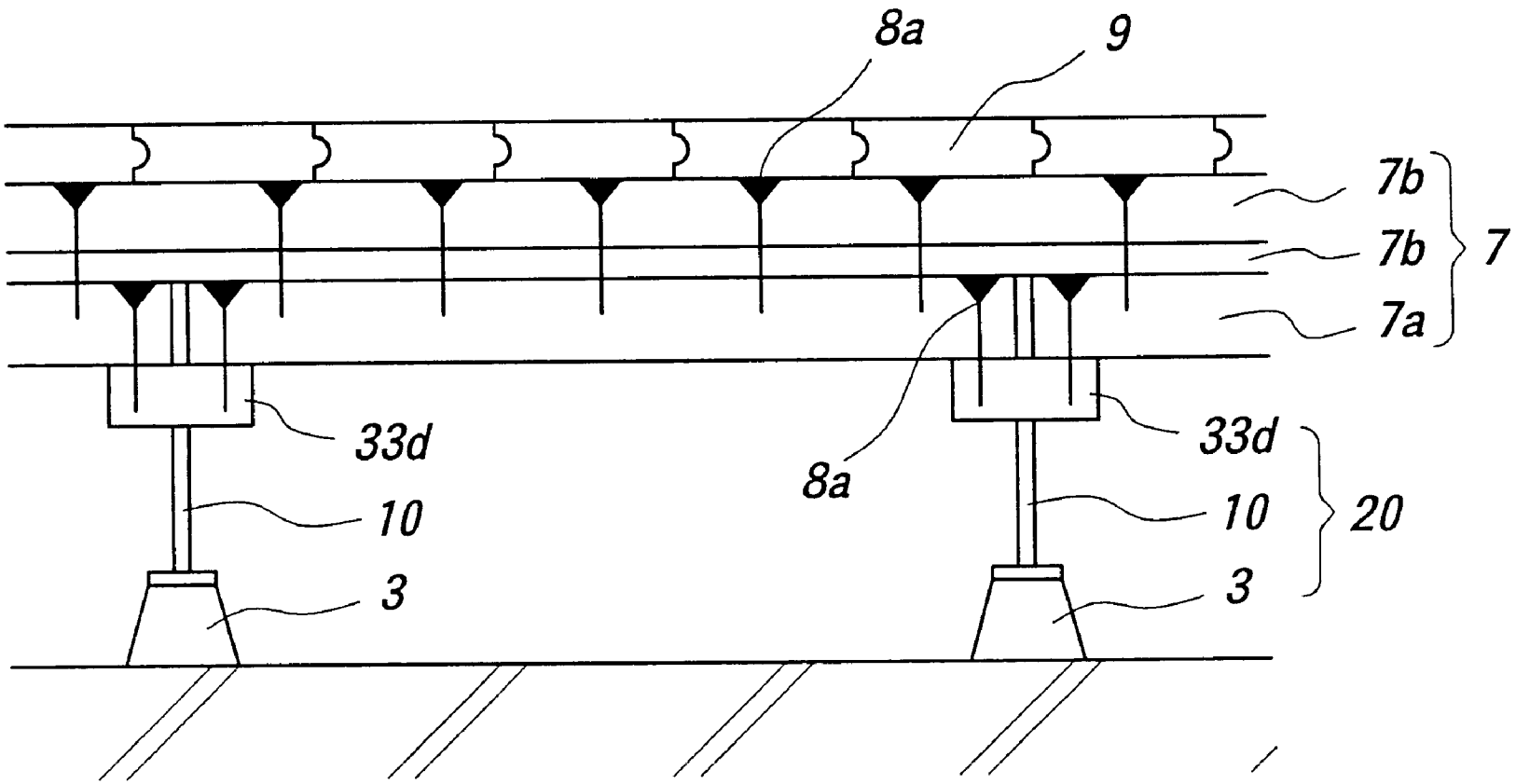
FIG. 19 is a partially sectional view of a commercially available double structure.
Figure 20:
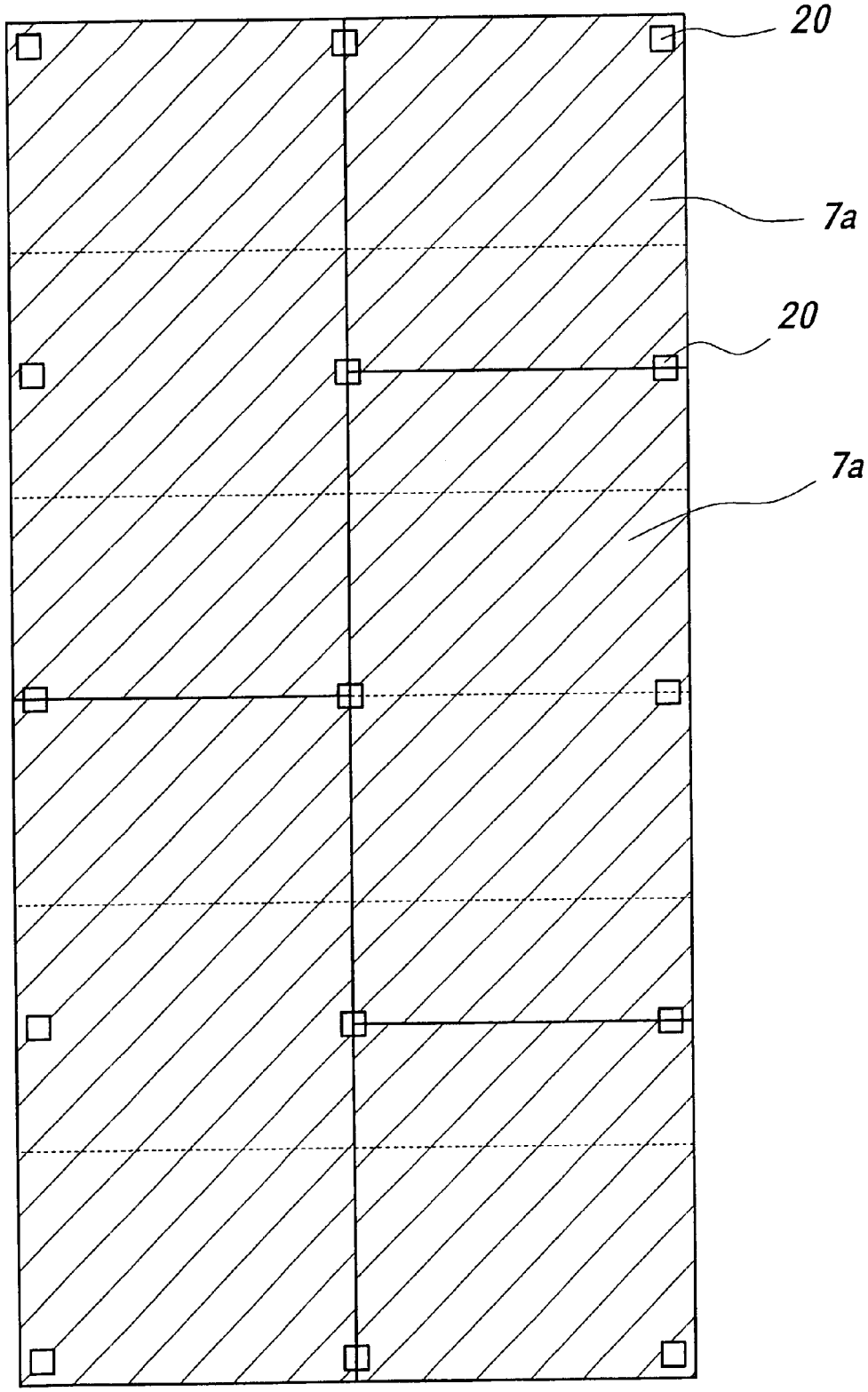
FIG. 20 is a plane view of the commercially available double structure of FIG. 19 as viewed from a side of the underfloor member.

Commercially available double structure shown in FIGS. 19 and 20 was constructed.

In the commercially available double floor, supporting legs were placed on an ALC floor base, and particle boards having 900 mm width×1800 mm length and 20 mm thickness were placed on adhesive-provided deck plates each having a 10-mm square shape such that the particle boards were spaced at a gap of 10 mm therebetween and at a core-to-core pitch of 900 mm. The particle boards were supported and fixedly screwed onto the supporting legs with T-shaped members. The supporting leg was constituted by a supporting iron rod having a height-adjusting screw, an SBR rubber part of hardness 70 fixed to a lower portion of the supporting leg and the deck plate for fixing the underfloor members.

Sound-insulating plates having 8 mm thickness×450 mm width×900 m length, and a particle board having 15 mm thickness×900 mm width×1800 mm length were placed and screw-fixed onto the 20 mm-thick particle board, thereby forming the underfloor member. A floor was formed by fixing flooring materials having 12 mm thickness×303 mm width×1818 length to the underfloor member with floor nails. At that time, long sides of the undermost 20 mm-thick particle boards, the sound-insulating plates, the 15 mm-thick particle boards and the 12 mm-thick flooring materials were alternatively made orthogonal. In the same manner as in Examples, heavy weight floor impact sounds were measured, and displacement amounts were measured at five locations of the floor under floor loads of 60 kg, 80 kg and 120 kg. Results are shown in Table 3.

TABLE 1

| | Example | | | | |
|---|---|---|---|---|---|
| | 1 | 2 | 3 | 4 | 5 |
| Support member unit mm | Laminated plate 5.5 mm thick × 100 mm width × 1800 mm long | Iron plate/visoelastic body/iron plate 4.2 mm thick × 100 mm wide × 1800 mm long Restraint type vibration-controlling support member | Upper support member laminate plate 5.5 mm × 100 width × 1818 mm long Lower support member laminate plate 3 mm thick × 100 mm width × 1818 mm long | Laminate plates 5.5 mm thick × 100 mm wide × 1818 mm long | Restraint type vibration-controlling support member of laminated plate/ viscoelastic body/ laminated plate 12 mm thick × 100 width × 1818 mm long |
| Impact-absorbing member unit mm | Cured body of liquid polybutadiene Five impact-absorbing members with frusto-pyramid shape having a lower 60 mm-square face, an upper 30 mm-square face and a 25-mm height/1818 mm length | Support member (polynorbornene) Four frusto-conical impact-absorbing members having a lower 50 mm-diameter face, an upper 30 mm-diameter face and a 15-mm height/1800 mm-long support member (polynor-bornene) having lower 40 mm-diameter face, an upper 30 mm-diameter face and a 10-mm height/1800 mm length | Tire powder-sealed rubber four frusto-pyramid impact-absorbing members having a lower 70 mm-square face, an upper 50 mm-square face and a 25-mm height/1818 mm long | Liquid polybutadiene cured bodies Three frusto-conical impact-absorbing members having a lower 46 mm-diameter face, an upper 23 mm-diameter face and a 25-mm height/1800 mm-long, two frusto-conical springs/1818 mm long | Liquid polybutadiene cured bodies Three frusto-conical impact-absorbing members having a lower 46 mm-diameter face, an upper 23 mm-diameter face and a 25 mm height and two frusto-conical impact-absorbing members having a lower 46 mm face and an upper 25.8 mm-diameter face and a 22 mm height, that is, totally fifth impact-absorbing members/ 1818 mm long |
| Pressure-sensitive adhesive | Foamed poly-ethylene sandwiched with pressure-sensitive acryl-based adhesive | Reclaimed pressure-sensitive butyl rubber-based adhesive | Same as in Example 1 | Same as in Example 2 | Same as Example 2 |
| Arrangement of floor base/ support member/undermost layer of underfloor member | Floor bases, undermost layers of underfloor members and support members: parallel Three support mem-bers per ome floor base and one under-most layer of underfloor member | Same as left | Floor bases and support members: orthogonal Support members and undermost layers of underfloor members: parallel Two support members per one undermost layer of underfloor member | Same as in Example 1 | Floor bases, undermost layers of underfloor members and support members: parallel Three support members per one floor base and one undermost layer of underfloor member |
| Sectional construction (from upper side) | Flooring materials, particle boards (3), support members, impact-absorbing | Flooring materials, particle boards (1), vibration-controlling and sound-insulating | Flooring members, particle boards (3), supporting members, impact-absorbing | Flooring materials, particle boards (2), gypsum board (1), particle boards (1), | Flooring materials, particle boards (2), vibration-controlling and sound-insulating |

TABLE 1-continued

| | Example | | | | |
|---|---|---|---|---|---|
| | 1 | 2 | 3 | 4 | 5 |
| | members, floor bases | members (1), particle boards (1), impact-absorbing members, supporting members, impacting absorbing members, floor bases | members, support members and floor bases | support members, impacting absorbing members, floor bases | members (1), particle boards (1), support members, impact-absorbing members, floor bases |
| Heavy floor impact sound dB | | | | | |
| 63 Hz | 77 | 76 | 76 | 75 | 75 |
| 125 Hz | 65 | 63 | 64 | 63 | 64 |
| 250 Hz | 54 | 52 | 49 | 49 | 50 |
| 500 Hz | 43 | 39 | 40 | 38 | 40 |
| 1 kHz | 36 | 34 | 33 | 32 | 33 |
| 2 kHz | 30 | 31 | 30 | 30 | 30 |
| 4 kHz | 28 | 28 | 27 | 28 | 27 |
| $L_H$ (determined frequency) | 54 (63 Hz) | 53 (63 Hz) | 53 (63 Hz) | 52 (63 Hz) | 52 (63 Hz) |
| Displacement under floor load | | | | | |
| 60 kg | 1.8 | 1.7 | 1.9 | 1.8 | 1.7 |
| 80 kg | 2.5 | 2.6 | 2.4 | 2.5 | 2.6 |
| 120 kg | 3.1 | 3.4 | 3.0 | 3.0 | 3.0 |
| Construction speed (min./tubo, construction from floor base to finish floor member) | 15 min./tubo | 15 min./tubo | 15 min./tubo | 16 min./tubo | 16 min./tubo |

TABLE 2

| | Example | | | | |
|---|---|---|---|---|---|
| | 6 | 7 | 8 | 9 | 10 |
| Support member unit mm | Lip-grooved steel + butyl rubber-based viscoelastic body with aluminum foil at one face 100 mm height × 50 mm width × 20 mm lip × 1.6 mm plate thickness × 1800 mm long | Square steel pipe + reclaimed butyl rubber-based viscoelastic bodies each having a polyester film at one face and attached to two inner vertical walls 100 mm high × 50 mm width × 1.6 mm thick × 1818 mm long | Viscoelastic body layers vertically laminated between four laminate plates, 80 mm high × 51 mm wide × 1818 mm long | Lip-grooved steel in which viscoelastic body is laminated on inner face and foam is filled in space | Tire powder, EPT and Foam powder filled in rectangular steel pipe |
| Impact-absorbing member unit mm | Cured body of liquid polybutadiene Five impact-absorbing members with frusto-pyramid shape having a lower 60 mm-square face, an upper 30 mm-square face and a 25-mm height/1818 mm length | Polynorbornene rubber Four impact-absorbing members with frusto-pyramid shape having a lower 40 mm-square face, an upper 20 mm-square face and a 25-mm height, 1800 mm length | Upper side, low foamed degree foam rubber (EPT/IIR)., 5 mm thick × 50 mm wide × 1818 mm long Lower side, five frus-to-pyramid impact-absorbing members having a lower 40 mm-square face, an upper 20 mm-square face and a 25-mm height | Eight oily clay-sealed rubbers 45 × 100 × 30 Two liquid butadiene cured bodies having a lower 46 mm-diameter face, an upper 18.4 mm-diameter face and a 30-mm height, totally five/1800 mm long | Four foam-sealed rubbers 40 × 100 × 30/1800 mm long |
| Pressure-sensitive adhesive | Pressure-sensitive reclaimed butyl rubber-based adhesive | Pressure-sensitive reclaimed butyl rubber-based adhesive Pressure-sensitive acryl-based adhesive | Pressure-sensitive reclaimed butyl rubber adhesive | Same as Example 8 | Pressure-sensitive acryl adhesive Pressure-sensitive reclaimed butyl-based adhesive |
| Arrangement of floor base/support member/undermost layer of underfloor member | Floor bases and support members: orthogonal Support members and undermost layers of underfloor members: parallel Two support members per one | Same as left | Same as Example 6 | Floor bases and support members: orthogonal Support members and undermost layers of underfloor members: parallel Three support members per one | Floor bases, undermost layers of underfloor members and support members: parallel Two support members per floor base and one undermost layer of underfloor member |

TABLE 2-continued

| | Example | | | | |
|---|---|---|---|---|---|
| | 6 | 7 | 8 | 9 | 10 |
| Sectional construction (from upper side) | undermost layer of underfloor member Flooring materials, particle boards (3), support members, impact-absorbing members, floor bases | Same as left | Same as Example 6 | undermost layer of underfloor member Same as Example 6 | Same as Example 6 |
| Heavy floor impact sound dB | | | | | |
| 63 Hz | 77 | 76 | 74 | 76 | 75 |
| 125 Hz | 64 | 63 | 64 | 65 | 62 |
| 250 Hz | 51 | 50 | 49 | 49 | 48 |
| 500 Hz | 40 | 37 | 38 | 38 | 36 |
| 1 kHz | 34 | 35 | 34 | 32 | 31 |
| 2 kHz | 30 | 33 | 30 | 29 | 28 |
| 4 kHz | 28 | 30 | 28 | 26 | 26 |
| $L_H$ (determined frequency) | 54 (63 Hz) | 53 (63 Hz) | 51 (63 Hz · 125 Hz) | 52 (63 Hz) | 52 (63 Hz) |
| Displacement under floor load | | | | | |
| 60 kg | 1.1 | 1.0 | 1.3 | 0.8 | 1.0 |
| 80 kg | 1.7 | 1.5 | 1.9 | 1.4 | 1.6 |
| 120 kg | 2.2 | 2.0 | 2.7 | 1.9 | 2.1 |
| Construction speed (min./tubo, construction from floor base to finish floor member) | 14 min./tubo | 14 min./tubo | 14 min./tubo | 14 min./tubo | 14 min./tubo |

TABLE 3

| | Example | | | Comparative |
|---|---|---|---|---|
| | 11 | 12 | 13 | Example 1 |
| Support member unit mm | Lip-groove steel 30 mm high × 60 mm wide × 600 mm long | Waste plastic shaped rectangular pipe 70 mm height × 70 mm wide × 600 mm long | Upper laminate plate 9 mm thick × 225 mm square Lower laminate plate 5.5 mm thick × 300 mm square | |
| Impact-absorbing member unit mm | Liquid polybutadiene cured bodies + polynorbornene rubber Two frusto-conical impact-absorbing members having a lower 46 mm-diameter face, an upper 23 mm-diameter face and a 25 mm height/600 mm long + frusto-conical spring + one polynornornene rubber having 50 mm-square and a 50 mm height (/600 mm long) | EPT rectangular pipe-shaped rubber in which a conical spring is set (one/600 mm long) + polynorbornene rubber having a lower 40 mm-square, a 20 mm-square and a 25-mm height (two/600 mm long). | Four frusto-pyramid liquid polybutadiene cured bodies having a lower 40 mm-square face, an upper 20 mm-square face and a 25 mm-height and one conical spring, totally five/sound-insulating floor member | SBR frusto-conical bodies having a lower 46 mm-diameter face, an upper 30 mm-diameter face and a 30 mm height and hardness 70, one body per one supporting leg |
| Pressure-sensitive adhesive | Pressure-sensitive reclaimed butyl rubber-based adhesive | Same as left | No | Pressure-sensitive reclaimed butyl rubber |
| Arrangement of floor base/support member/undermost layer of underfloor member | Floor bases, undermost layer of underfloor members and support members: orthogonal Five support members per one floor base and one underfloor member | Floor bases and support members: parallel Support members and undermost layers of under-floor members: orthogonal, five support members per one lowermost layer of under-floor member | Sound-insulating members independently arranged at seams between floor bases and seams between undermost layers | Floor bases and undermost layers of underfloor members being orthogonal and support members being arranged therebetween |
| Sectional construction (from upper side) | Flooring materials, particle boards (2), support members, impact-absorbing members and floor bases | Flooring materials, laminate plates (2), particle boards, support members, impact-absorbing members and floor bases | Flooring materials, particle boards (2), vibration controlling and sound-insulating member, particle boards, support members, impact-absorbing members, support support members and floor | Flooring materials, particle board, vibration-controlling and sound-insulating members, particle board, support members and floor bases |

TABLE 3-continued

| | Example | | | Comparative |
|---|---|---|---|---|
| | 11 | 12 | 13 | Example 1 |
| | | | base | |
| Heavy floor impact sound dB | | | | |
| 63 Hz | 77 | 75 | 78 | 88 |
| 125 Hz | 66 | 64 | 69 | 74 |
| 250 Hz | 51 | 50 | 58 | 62 |
| 500 Hz | 39 | 37 | 47 | 53 |
| 1 kHz | 37 | 35 | 36 | 37 |
| 2 kHz | 36 | 33 | 31 | 30 |
| 4 kHz | 33 | 31 | 29 | 28 |
| $L_H$ (determined frequency) | 54 (63 Hz) | 52 (63 Hz) | 55 (63 Hz) | 65 (63 Hz) |
| Displacement under floor load | | | | |
| 60 kg | 1.2 | 0.9 | 2.0 | 3.0 |
| 80 kg | 2.1 | 1.4 | 2.8 | 5.8 |
| 120 kg | 2.8 | 1.9 | 3.8 | 4.6 |
| Construction speed (min./tubo, construction from floor base to finish floor member) | 14 min./tubo | 15 min./tubo | 30 min./tubo | 38 min./tubo |

The measurement results of Examples and Comparative Examples will be explained with reference to Tables 1 to 3.

In Example 1, the support members had the same length as that of the underfloor member, and bonded to the lowermost layer of the underfloor member with the acryl pressure-sensitive adhesive at a central portion and the locations spaced from the opposite ends in the longitudinal direction by 100 mm. The bonded area ratio is 39.6% per one particle board (606 mm width×1818 mm length) of the underfloor member, which exhibits a restraint type vibration-controlling function.

Further, five cured liquid polybutadiene parts having 60 mm square/30 mm square×25 mm height were supported by the support members having a length of 1818 mm at the opposite ends and three points for dividing the interval between the opposite ends into quadrisections.

As a result, an $L_H$ value was 54, which was better than in Comparative Example 1 by 11 dB.

Further, construction workability was shortened by 23 minutes per one tsubo (=3.3 $m^2$). Clearly, construction becomes easier.

Example 2 is an example in which the support members are restraint type vibration-controlling plates, and the impact-absorbing members are used above and under the support members. In this case, the vibration of the underfloor member is not restrained by the support members, but the vibration-restraining effect was as high as $L_H$ 53. The high frequency side is at an equivalent level to that of Comparative Example 1, which is not a level adversely affecting the heavy floor impact sounds.

This is considered to be effectively attributable to absorption of impacts with the impact-absorbing members but also the deformation absorption with the supporting members. The construction workability was shortened by 23 minutes/tubo, which shows merits in the reduced number of construction steps and easiness in construction.

Example 3 is an example in which the upper and lower support members are used, and the $L_H$ was reduced by 12 dB as compared with Comparative Example 1. Thus, cost reduction effect is large. Further, construction workability is good, and the construction period is shortened by 23 minutes/tubo.

Example 4 is an example in which two kinds of the impact-absorbing members are used, and the support members restrain 8.7% in an area ratio of the underfloor member. As compared with Comparative Example 1, the $L_H$ was improved by 13 dB, and the construction workability is improved with shortening by 22 minutes/tubo.

Example 5 is an example in which the support members are the restraint type vibration-controlling support members and the restrain area ratio of the underfloor member with the support members is 39.6%. As compared with Comparative Example 1, the $L_H$ could be reduced by 13 dB. The impact-absorbing members have different heights: three 25 mm-high members and two 22 mm-high members for one support member. The construction workability is good with shortening by 22 minutes/tubo.

In Example 6, the height of the support members is high so that piping is possible under the floor. The floor impact sounds are better than Comparative Example 1 by 11 dB, and construction workability can be shortened by 24 minutes/tubo. The displacement of the floor is small, so that the stable floor is obtained.

In Example 7, the height of the support members is also high so that piping is possible under the floor. The floor impact sounds are better than Comparative Example 1 by 12 dB, and construction workability good and shortened by 24 minutes/tubo.

In Example 8, the height under the floor can be adjusted so that piping may be possible. The impact-absorbing members are provided above and under the support members, and the floor impact sounds are reduced by 14 dB as compared with Comparative Example 1. Construction workability is good, and can be shortened by 24 minutes/tubo. The displacement under the floor load is small. Judging from the sound performance and the floor displacement, $L_H$ 55 level can be sufficiently realized under cost down by reducing the thickness of the underfloor member.

In Example 9, vibration-controlling is effected by the support members so as to utilize the space under the floor for underfloor piping. The underfloor member is supported by three support members in the longitudinal direction, and is restrained by the support members at the restraint area ratio of 19.8%, so that vibration of the underfloor member is reduced. As a result, the $L_H$ is reduced as compared with Comparative Example 1 by 13 dB. The construction workability is further improved with being shortened by 24 minutes/tubo. The displacement of the floor under load is small, and floor performance is good.

Example 10 is suitable for a construction method utilizing a space under the floor for underfloor piping or the like. The underfloor member is supported by two support members, the underfloor member is restrained at the restraint area ratio of 13.2% between the support members, and the vibration of the underfloor member is reduced. As a result, the $L_H$ is improved by 13 dB as compared with Comparative Example 1. The impact-absorbing members use the foam-filled rubber parts, and construction workability is further improved with being shortened by 24 minutes/tubo. Excellent effects are obtained in that the displacement against the floor load is very small due to the bending rigidity of the support members.

In Example 11, the impact-absorbing members are arranged in the bent hollow portion of the lip groove-shaped steel, and the support members having high bending rigidity are used, but the height under the floor does not increases. Five support members having the same length as that of the short sides of the underfloor member are used, and the restraint area of the underfloor member is 13.7%. The $L_H$ is improved by 11 dB as compared with Comparative Example 1. Construction workability is sufficiently improved with being shortened by 24 minutes/tubo. The displacement against the floor load is small, which is attributable to the bending rigidity of the support members.

In Example 12, the space is ensured for the utilizing the underfloor, and the underfloor member is supported by five support members having the same length as that of the short sides of the underfloor member. The restrain area ratio of the underfloor member is 13.7%. In the impact-absorbing member, the frusto-conical spring is surrounded with the rectangular pipe-shaped rubber part having a height than the spring by 2 mm, so that after the rectangular pipe-shaped rubber part deforms upon impacts, the spring acts, thereby preventing adverse effect of impact repulsion resulting from the elasticity of the spring. The other impact absorbing member is a frusto-pyramid rubber part. The floor impact sounds are reduced by 13 dB as compared with Comparative Example 1. Construction workability is further improved with being shortened by 23 minutes/tubo. Results are excellent in that displacements under the floor loads are small.

In Example 13, the impact-absorbing members are the cured liquid polybutadiene parts arranged at four corners between the upper and lower plates, and the conical spring having a smaller height is arranged in the center portion. This Example is suitable for a case where the height is desired to be lowered. As a result, the $L_H$ is reduced by 10 dB as compared with Comparative Example 1, and construction workability is shortened by 8 minutes/tubo. The displacements under the floor loads are larger among Examples, which is no practical problem in that the displacements are lower than in Comparative Example ordinarily used at present.

As mentioned above, the heavy floor impact sounds of the sound-insulating floor structures can be further reduced by utilizing the present invention. Further, construction workability is good with easy construction.

Furthermore, the sound-insulating floor structures according to the present invention can be constructed with no skill. Even if anyone constructs the floor structure, the heavy floor impact sounds can be further reduced, and similar finish states can be obtained. The sound-insulating floor structures according to the present invention have less deformations under the floor loads and give good walking feeling.

INDUSTRIAL APPLICABILITY

According to the present invention, since the plural impact-absorbing members are supported by the slender support members having a length equivalent to the long sides or the short sides of the floor base or the underfloor member, the heavy floor impact sounds of the sound-insulating floor structure can be largely reduced, the construction workability of the sound-insulating floor structure is improved, and the displacement under the floor loads can reduced.

What is claimed is:

1. A sound-insulating floor structure comprising a floor base, a plurality of sound-insulating floor members arranged on the floor base, and an underfloor member placed on the sound-insulating floor members, each of said sound-insulating floor members comprising a plurality of impact-absorbing members and a support member supporting said impact-absorbing members, said impact-absorbing members being provided on lower faces and optionally on upper faces of the support member, said impact-absorbing members on the lower faces of the support member extending to the floor base, each of said sound-insulating floor members being fixed to the floor base or the underfloor member to support the underfloor member, and each of the impact-absorbing members possesses at least one spring characteristic selected from a linear spring, a degressive spring, progressive spring and a stationary load spring, and at least one impact-absorbing member has a spring characteristic different from that of another impact-absorbing member.

2. The sound-insulating floor structure set forth in claim 1, wherein said floor base is constituted by connecting a plurality of floor bases in a same direction, and/or said underfloor member is constituted by connecting a plurality of underfloor members in a same direction, and said sound-insulating floor members are arranged to be orthogonal to a seam or seams of the floor bases or the underfloor members.

3. A sound-insulating floor member to be provided between a floor base and an underfloor member above said floor base, said sound-insulating floor member comprising a plurality of impact-absorbing members and a support member supporting said impact-absorbing members, said impact-absorbing members being provided on lower faces and optionally on upper faces of the support member, wherein when a plurality of said sound-insulating floor members are arranged between the floor base and the underfloor member, said impact-absorbing members on the lower faces of the support member extending to the floor base and each of said sound-insulating floor member being fixed to the floor base or the underfloor member to support the underfloor member, and each of the impact-absorbing members possesses at least one spring characteristic selected from a linear spring, a degressive spring, progressive spring and a stationary load spring, and at least one impact-absorbing member has a spring characteristic different from that of another impact-absorbing member.

4. The sound-insulating floor member set forth in claim 3, wherein each of the impact-absorbing members comprises at least one kind of rubber selected from the group consisting of a gas-sealed rubber, a fiber-sealed rubber, a foam-sealed rubber, a clay-sealed rubber and a liquid-sealed rubber.

5. The sound-insulating floor member set forth in claim 4, wherein the impact-absorbing members comprise higher impact-absorbing members and lower impact-absorbing members, the higher impact-absorbing members support the underfloor member, spaces are formed between the lower impact-absorbing members and the underfloor member, the support members or the floor base, and when the underfloor member displaces upon receipt of the impact, the lower impact-absorbing members contact the underfloor member, the support members or the floor base.

6. The sound-insulating floor member set forth in claim 5, wherein said support members comprise bent plates each formed by bending a slender plate in a width direction or cylindrical members.

7. The sound-insulating floor member set forth in claim 6, wherein a viscoelastic body is laminated upon an inner face of the bent plate or the cylindrical member.

8. The sound-insulating floor member set forth in claim 7, wherein at least one material selected from the group consisting of a foam, a fibrous material, a powder, a material obtained by fixing said powder with a binder and a damping material is filled in an inner side of said bent plate or said cylindrical member.

9. The sound-insulating floor member set forth in claim 6, wherein at least one material selected from the group consisting of a foam, a fibrous material, a powder, a material obtained by fixing said powder with a binder and a damping material is filled in an inner side of said bent plate or said cylindrical member.

10. The sound-insulating floor member set forth in claim 4, wherein said support members comprise bent plates each formed by bending a slender plate in a width direction or cylindrical members.

11. The sound-insulating floor member set forth in claim 10, wherein a viscoelastic body is laminated upon an inner face of the bent plate or the cylindrical member.

12. The sound-insulating floor member set forth in claim 11, wherein at least one material selected from the group consisting of a foam, a fibrous material, a powder, a material obtained by fixing said powder with a binder and a damping material is filled in an inner side of said bent plate or said cylindrical member.

13. The sound-insulating floor member set forth in claim 10, wherein at least one material selected from the group consisting of a foam, a fibrous material, a powder, a material obtained by fixing said powder with a binder and a damping material is filled in an inner side of said bent plate or said cylindrical member.

14. The sound-insulating floor member set forth in claim 3, wherein the impact-absorbing members comprises higher impact-absorbing members and lower impact-absorbing members, the higher impact-absorbing members support the underfloor member, spaces are formed between the lower impact-absorbing members and the underfloor member, the support members or the floor base, and when the underfloor member displaces upon receipt of the impact, the lower impact-absorbing members contact the underfloor member, the support members or the floor base.

15. The sound-insulating floor member set forth in claim 14, wherein said support members comprise bent plates each formed by bending a slender plate in a width direction or cylindrical members.

16. The sound-insulating floor member set forth in claim 15, wherein a viscoelastic body is laminated upon an inner face of the bent plate or the cylindrical member.

17. The sound-insulating floor member set forth in claim 16, wherein at least one material selected from the group consisting of a foam, a fibrous material, a powder, a material obtained by fixing said powder with a binder and a damping material is filled in an inner side of said bent plate or said cylindrical member.

18. The sound-insulating floor member set forth in claim 15, wherein at least one material selected from the group consisting of a foam, a fibrous material, a powder, a material obtained by fixing said powder with a binder and a damping material is filled in an inner side of said bent plate or said cylindrical member.

19. The sound-insulating floor member set forth in claim 3, wherein said support members comprise bent plates each formed by bending a slender plate in a width direction or cylindrical members.

20. The sound-insulating floor member set forth in claim 19, wherein a viscoelastic body is laminated upon an inner face of the bent plate or the cylindrical member.

21. The sound-insulating floor member set forth in claim 20, wherein at least one material selected from the group consisting of a foam, a fibrous material, a powder, a material obtained by fixing said powder with a binder and a damping material is filled in an inner side of said bent plate or said cylindrical member.

22. The sound-insulating floor member set forth in claim 19, wherein at least one material selected from the group consisting of a foam, a fibrous material, a powder, a material obtained by fixing said powder with a binder and a damping material is filled in an inner side of said bent plate or said cylindrical member.

23. A method for constructing a sound-insulating floor structure comprising a floor base, a plurality of sound-insulating floor members on said floor base, and an underfloor member on the sound-insulating floor members, said method comprising the steps of preparing a plurality of impact-absorbing members and support members for supporting said impact-absorbing members, forming each of the sound-insulating floor members by providing the impact-absorbing members on lower faces and optionally on upper faces of the support member, arranging the sound-insulating floor members between the floor base and the underfloor member such that the impact-absorbing members on the lower faces of the support member extend to the floor base, fixing each of the sound-insulating floor members to the floor base or the underfloor member, and thereby supporting the underfloor member with the sound-insulating floor members.

* * * * *